US008180260B2

(12) United States Patent
Yanagi

(10) Patent No.: US 8,180,260 B2
(45) Date of Patent: May 15, 2012

(54) IMAGE FORMING APPARATUS COMPRISING A VIBRATION APPLYING MEMBER

(75) Inventor: Yuya Yanagi, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 774 days.

(21) Appl. No.: 12/324,423

(22) Filed: Nov. 26, 2008

(65) Prior Publication Data

US 2009/0142105 A1 Jun. 4, 2009

(30) Foreign Application Priority Data

Nov. 30, 2007 (JP) ..... 2007-309704

(51) Int. Cl.
*G03G 15/08* (2006.01)

(52) U.S. Cl. ..... 399/258; 399/260

(58) Field of Classification Search ..... 399/12, 399/13, 27, 258, 260, 261
See application file for complete search history.

(56) References Cited

U.S. PATENT DOCUMENTS

| | | | | |
|---|---|---|---|---|
| 5,270,785 | A * | 12/1993 | Kita et al. | 399/261 |
| 6,215,974 | B1 * | 4/2001 | Katoh et al. | 399/258 |
| 6,405,010 | B2 | 6/2002 | Ashikari et al. | |
| 7,184,686 | B2 | 2/2007 | Kanno et al. | |
| 7,395,015 | B2 * | 7/2008 | Ishiguro et al. | 399/258 |
| 7,697,858 | B2 * | 4/2010 | Moon et al. | 399/261 |

FOREIGN PATENT DOCUMENTS

| | | | |
|---|---|---|---|
| JP | 10-063082 | A | 3/1998 |
| JP | 2001-337524 | A | 12/2001 |
| JP | 2002-278237 | A | 9/2002 |
| JP | 2006-71808 | A | 3/2006 |

* cited by examiner

*Primary Examiner* — William J Royer
(74) *Attorney, Agent, or Firm* — Canon U.S.A., Inc., IP Division

(57) ABSTRACT

An image forming apparatus includes a vibration applying member for vibrating a developer containing unit in a state where a conveying member for conveying a developer is stopped in a developer cartridge.

16 Claims, 19 Drawing Sheets

IMAGE FORMING APPARATUS COMPRISING A VIBRATION APPLYING MEMBER

BACKGROUND OF THE INVENTION

1. Field of the Invention

The present invention relates to image forming apparatuses.

2. Description of the Related Art

Conventionally, there has been an electrophotographic image forming apparatus as one example of an image forming apparatus. The electrophotographic image forming apparatus (hereinafter referred to as an image forming apparatus) is configured to form an image on a recording medium using an electrophotographic image forming process. The image forming apparatus includes an electrophotographic copying machine and an electrophotographic printer (e.g., a light-emitting diode (LED) printer or a laser beam printer). In the image forming apparatus using an electrophotographic image forming process, a process cartridge system capable of attaching/detaching a cartridge to the image forming apparatus body is available, and the cartridge integrally includes an electrophotographic photosensitive member and process units acting on the electrophotographic photosensitive member. According to the process cartridge system, a user can perform maintenance of the apparatus by himself without relying on a serviceman. Therefore, operability of the image forming apparatus can be improved.

On the other hand, there is a difference between a consumption period of a developer and a life period of a processing means. Thus, some apparatuses separately include a process cartridge having a developing device and a toner cartridge for supplying a developer (hereinafter referred to as "toner").

This toner cartridge is called a toner supplying type cartridge.

In this system, a toner is an ultra fine powder. Thus, in a toner supplying operation, the toner cartridge is put within the image forming apparatus body so that the toner is not scattered, and the toner is supplied in small quantities from a small supplying outlet in the toner cartridge to the process cartridge.

When such a toner cartridge is left and stored under a vibration in the course of a physical distribution or at high temperature and high humidity for a long period of time, toner clumps together so that a toner may be solidified (that is, a toner bridge) in a container body. As a consequence, if the clumped toner having low fluidity is supplied to a small opening part, the opening part may be clogged with the toner (that is, a packing may occur). In such a case, the toner is not discharged from the opening part so that a shortage of the toner appears near a developing roller in a developing container, and thus a normal image may not be obtained.

Therefore, it is necessary to constantly discharge a predetermined amount of the toner by using a method for breaking the toner bridge so as to keep uniform fluidity.

Japanese Patent Application Laid-Open No. 10-63082 discusses a method in which a projection part formed on an inner wall of a conveying member comes to contact with the toner conveying member constituted by an elastic body that is driven to apply vibration to the conveying member.

However, when the vibration is applied while conveying a toner, the clumped toner is forwarded before the toner is broken, and thus a packing may become worse.

SUMMARY OF THE INVENTION

The present invention is directed to an image forming apparatus and a cartridge capable of breaking a clumped developer without causing further clumping.

According to an aspect of the present invention, an image forming apparatus configured to form an image on a recording medium includes a developing device comprising a first developer containing unit and a developing roller. The first developer containing unit has a receiving inlet for receiving developer from an external device. The first developer containing unit also contains the received developer. The developing roller is configured to develop a latent image formed on an image bearing member using the developer contained in the first developer containing unit.

The image forming apparatus further includes a developer cartridge comprising a second developer containing unit and a developer conveying member. The second developer containing unit contains developer and has a supplying outlet for supplying the contained developer to the receiving inlet. The developer conveying member is provided at an inner side of the second developer containing unit and conveys the developer contained in the second developer containing unit to the supplying outlet. The developer cartridge is detachably attached to an apparatus body of the image forming apparatus The image forming apparatus further includes a vibration applying member for applying vibration to the second developer containing unit in a state where the developer conveying member is stopped after the developer cartridge is attached to the apparatus body and before the developer conveying member conveys the developer contained in the second developer containing unit to the supplying outlet.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DETAILED DESCRIPTION OF THE EMBODIMENTS

Various exemplary embodiments, features, and aspects of the invention will be described in detail below with reference to the drawings.

Figure 1:
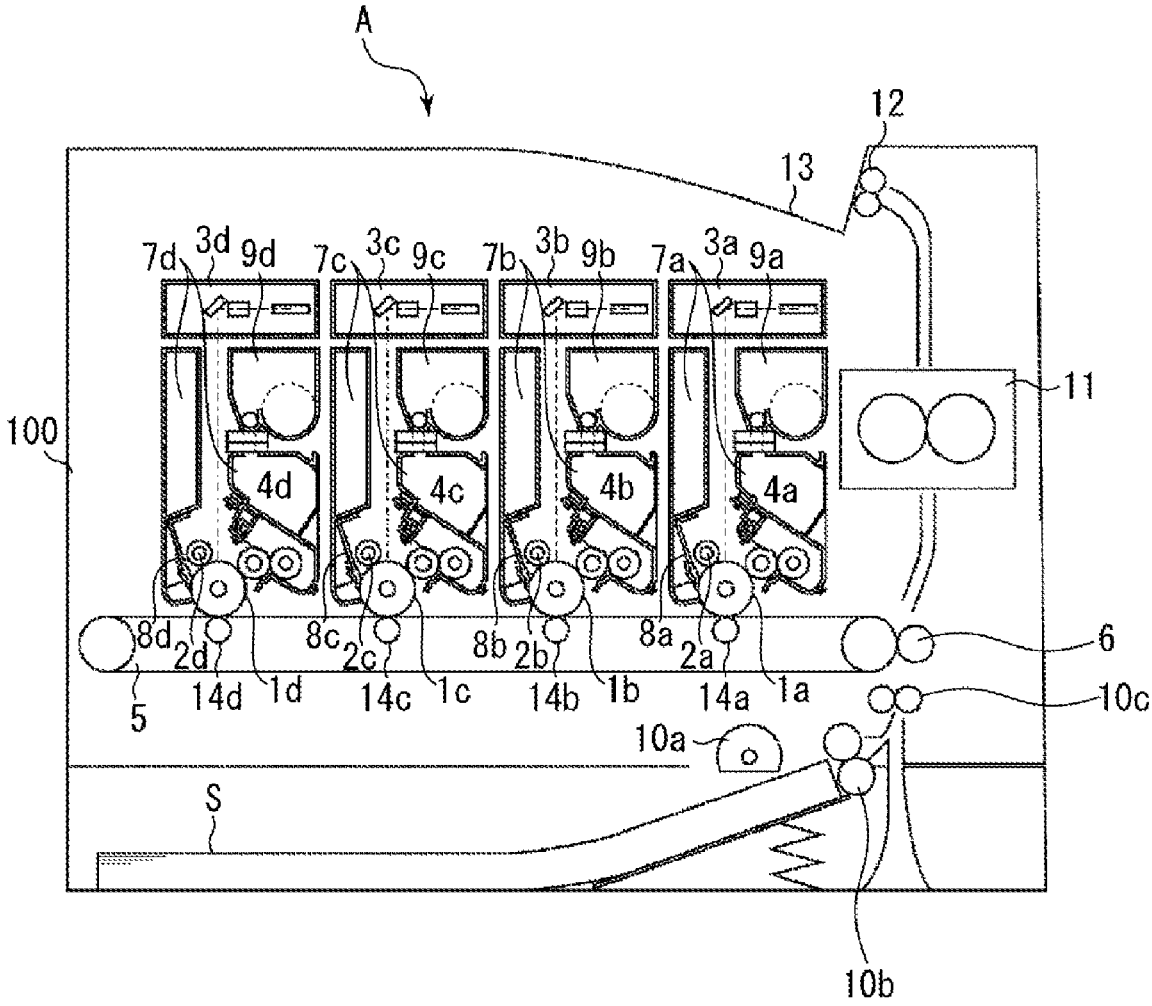
FIG. 1 is a cross sectional view of an electrophotographic color image forming apparatus according to a first exemplary embodiment of the present invention.

FIG. 1 is a longitudinal cross sectional view to illustrate a whole configuration of a full-color laser beam printer as a multicolor image forming apparatus according to a first exemplary embodiment of the present invention.

A multicolor image forming apparatus 100 includes four photosensitive drums 1 (1*a*, 1*b*, 1*c*, 1*d*) as image bearing members which are arranged in a horizontal direction. The photosensitive drum 1 is a drum-shaped electrophotographic photosensitive member. The photosensitive drum 1 is rotationally driven by a driving unit (not illustrated). Around the photosensitive drums 1, charging rollers 2 (2*a*, 2*b*, 2*c*, 2*d*), scanner units 3 (3*a*, 3*b*, 3*c*, 3*d*), and developing devices 4 (4*a*, 4*b*, 4*c*, 4*d*) are provided. The charging roller 2 is a charging device for uniformly charging a surface of the photosensitive drum 1. The scanner unit 3 irradiates with a laser beam based on image information to form an electrostatic latent image on the photosensitive drum 1. The developing device 4 causes a toner as a developer to adhere to the latent image to develop the image as a toner image. Further, above the developing devices 4, toner cartridges 9 (9*a*, 9*b*, 9*c*, 9*d*) for supplying a toner to the developing devices 4 are detachably mounted on an apparatus body A of the image forming apparatus 100.

An intermediate transfer member 5 is provided on the lower side of the photosensitive drum 1, and the toner image formed on the photosensitive drum 1 is transferred onto the intermediate transfer member 5 by first transfer units 14 (14*a*, 14*b*, 14*c*, 14*d*). The image forming apparatus 100 further includes a second transfer unit 6 for transferring the toner image transferred to the intermediate transfer member 5 onto a recording medium S, a fixing unit 11 for fixing the toner image on the recording medium S, and cleaning devices 8 (8*a*, 8*b*, 8*c*, 8*d*) for removing a transfer residual toner remaining on the surface of the photosensitive drum 1 after transferring.

The photosensitive drum 1, the charging device 2, the developing device 4, and the cleaning device 8 are integrated into a cartridge as process cartridges 7 (7*a*, 7*b*, 7*c*, 7*d*), and the process cartridges 7 are detachably attached to the apparatus body A. Although the developing devices 4 are detachably attached to the apparatus body A according to the present embodiment, the developing devices 4 may alternatively be fixed at the apparatus body A.

In an operation of image forming, each process cartridge 7 is driven sequentially according to timing of image forming, and each photosensitive drum 1 is rotated according to the driving of the process cartridge 7. Then, each scanner unit 3 corresponding to each process cartridge 7 is sequentially driven. Further, by rotation of the photosensitive drum 1, the driven charging roller 2 that rotates in contact with the photosensitive drum 1 applies a uniform electric charge to a peripheral face of the photosensitive drum 1. Further, the scanner unit 3 selectively exposes the peripheral face of the photosensitive drum 1 to the laser beam according to an image signal to form an electrostatic latent image on the peripheral face of the photosensitive drum 1. The developing roller in the developing device 4 transfers a toner onto the latent image to form a toner image on the peripheral face of the photosensitive drum 1.

Then, a bias voltage having a reverse polarity to the toner is applied to the first transfer unit 14 in the intermediate transfer member 5. According to the bias application, the toner image on the photosensitive drum 1 is superposed on the intermediate transfer member 5 to be primarily transferred.

The conveying unit conveys the recording medium S in synchronization with the aforementioned image forming. More specifically, one recording medium S set at a lower part of the apparatus body A is separated and fed one by one by a pair of a supplying roller 10*a* and a separating roller 10*b*. Then, the recording medium S is fed to a nip part between the intermediate transfer member 5 and the second transfer unit 6 by a registration roller pair 10*c* according to the timing of image forming.

The second transfer unit 6 is applied with the bias voltage having the reverse polarity to the toner. Therefore, the toner image on the intermediate transfer member 5 is secondarily transferred collectively onto the surface of the conveyed recording medium S.

The recording medium S on which the toner image is secondarily transferred is conveyed to the fixing unit 11 to fix the toner image. Then, the recording medium S is discharged to a discharge tray 13 by a discharge roller 12. Thus, the image is formed on the recording medium S.

Figure 2B:
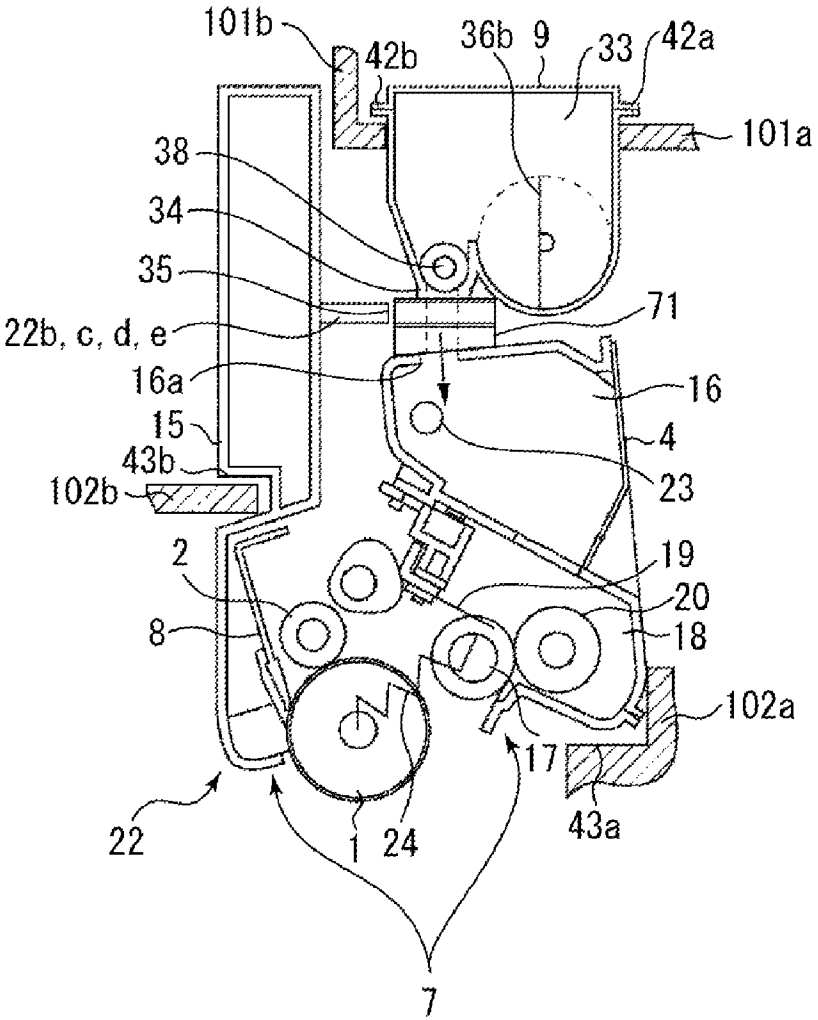
FIGS. 2A and 2B are cross sectional views of a process cartridge and a toner cartridge, which are attached to an electrophotographic color image forming apparatus according to the first exemplary embodiment of the present invention.
Figure 2A:
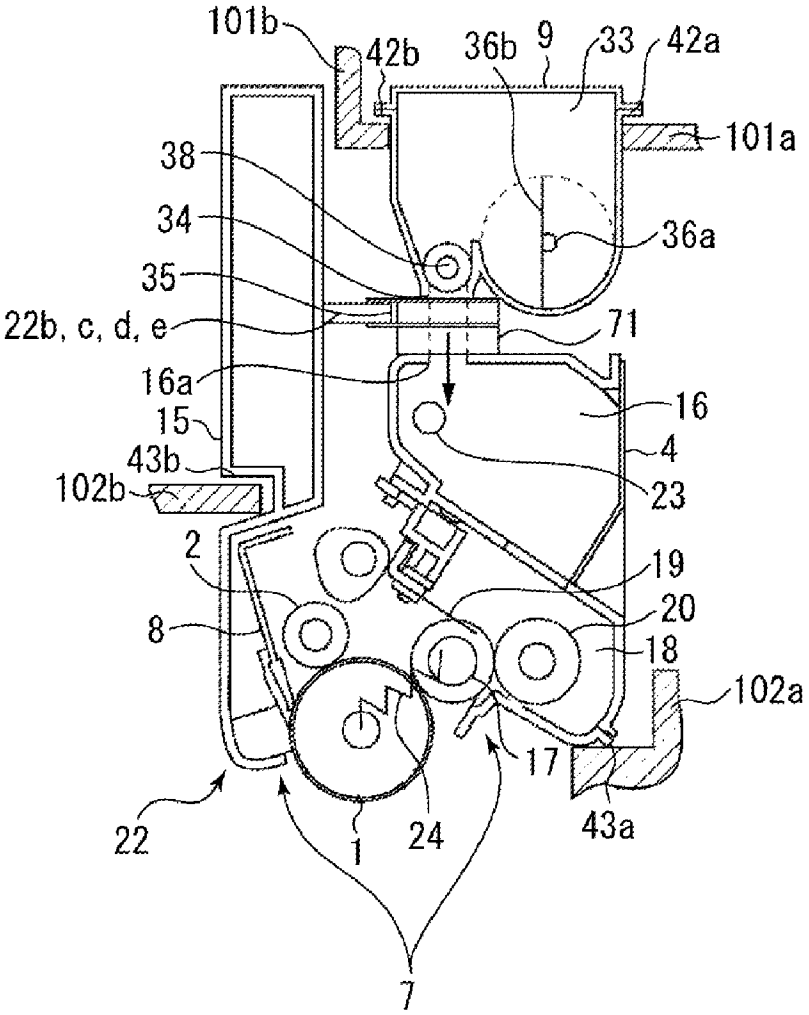

Then, the frame configuration of the process cartridge 7 will be described with reference to FIGS. 2A and 2B. As illustrated in FIGS. 2A and 2B, the process cartridge 7 integrally includes a cleaning unit 22 and a developing device 4 as a developing section, which are independently configured.

The cleaning unit 22 includes a cleaning container 15, a charging roller 2, and a cleaning blade 8. The cleaning container 15 is a frame body for rotatably supporting the photosensitive drum 1. The charging roller 2 is configured to uniformly charge the surface of the photosensitive drum 1. The cleaning blade 8 removes a transfer residual toner remaining on the surface of the photosensitive drum 1 after the image transfer. The charging roller 2 and the cleaning blade 8 are arranged in the cleaning container 15.

On the other hand, as for the frame configuration of the developing device 4, a toner container 16 for containing a toner as a developer and a developing container 18 are jointed by, for example, ultrasonic fusion. The developing container 18 is a frame body for rotatably supporting a developing roller 17 as a developer bearing member. The developing roller 17 develops a latent image using a toner in the toner container 16. The toner container 16 and the developing container 18 are a first developer containing unit (16, 18) for a toner.

In the developing container 18, a developing blade 19 and a toner supplying roller 20 are provided other than the developing roller 17. The developing blade 19 is configured to control the layer thickness of a toner on the developing roller 17. The toner supplying roller 20 is a sponge roller for supplying a toner to the developing roller 17.

The cleaning unit 22 and the developing device 4 are connected, for example, by inserting a parallel pin into connection holes formed at both ends of the developing device 4 and connection holes formed at both ends of the cleaning unit 22. In this way, the developing device 4 is supported relative to the cleaning unit 22. More specifically, the developing device 4 is capable of swinging around a shaft 23 relative to the cleaning unit 22. Further, the developing device 4 is urged to the cleaning unit 22 by a spring 24 serving as an urging member so that the photosensitive drum 1 contacts the developing roller 17.

Figure 13:
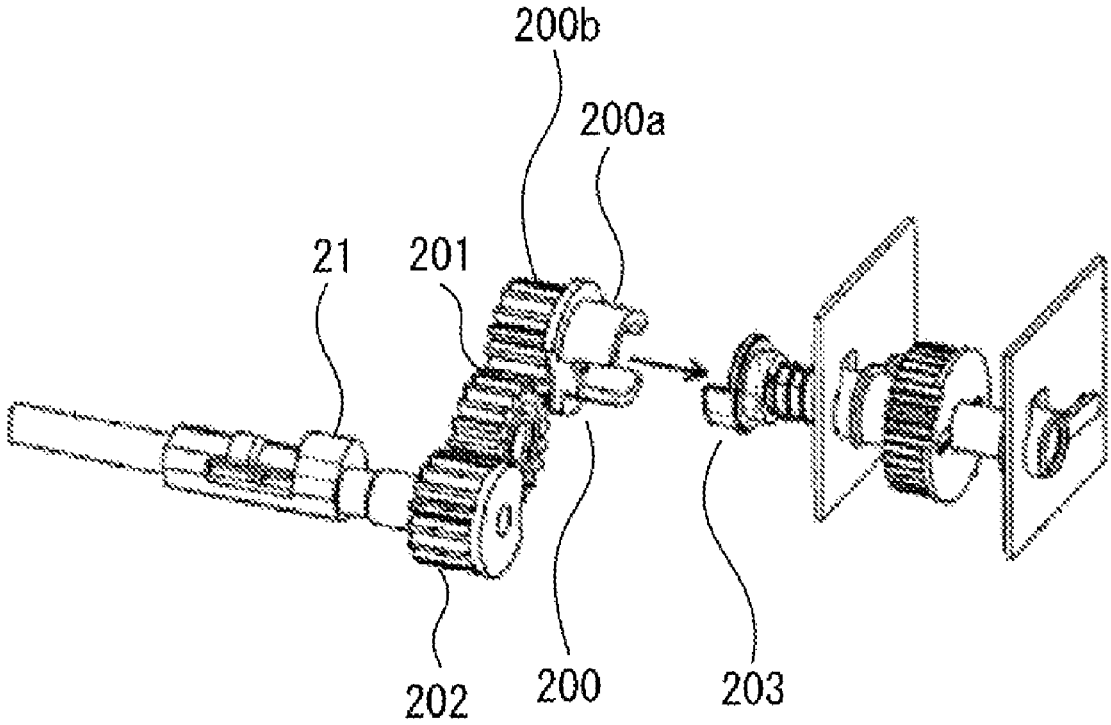
FIG. 13 is a perspective view to illustrate a cam receiving a power according to the first exemplary embodiment of the present invention.
Figure 13:
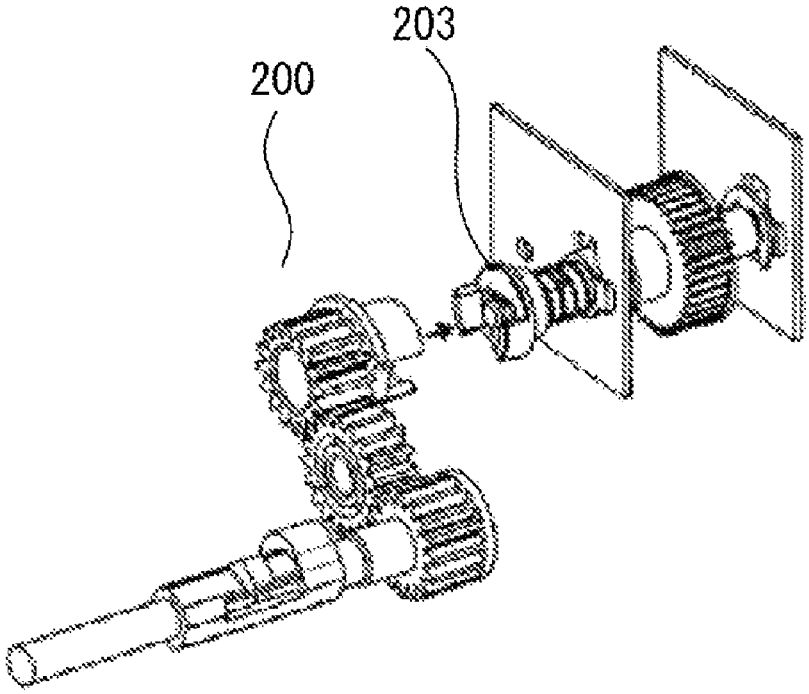

In this embodiment, the cleaning unit 22 includes a cam 21 (FIG. 13) as a swing member. The cam 21 can move between a first position in FIG. 2A and a second position in FIG. 2B driven by a driving unit (not illustrated) in the apparatus body A. When the cam 21 is at the first position, a smaller diameter part of the cam 21 faces the developing device 4 and the cam 21 does not contact the developing device 4. Therefore, the photosensitive drum 1 is in contact with the developing roller 17 at the first position by the spring 24. On the other hand, when the cam 21 is at the second position, a larger diameter part of the cam 21 faces the developing device 4 and the cam 21 urges the developing device 4 against the force of the spring 24. Thus, the photosensitive drum 1 and the developing roller 17 are separated. More specifically, in the aforementioned configuration, the photosensitive drum 1 can contact the developing roller 17 at a time of forming an image and can be separated from the developing roller 17 when an image is not formed. Accordingly, imaged defects caused by a constant contact between the photosensitive drum 1 and the developing roller 17 can be suppressed.

The image forming apparatus 100 includes a toner cartridge 9 on the upper side of the developing device 4. Further, the developing device 4 includes a toner supplied port 16*a* as an inlet for receiving a toner from an external source (from the cartridge 9). The developing device 4 includes a seal member 71 (foamed urethane or felt) as an elastic body for keeping a contact with the toner cartridge 9 and preventing leakage of a toner from the contact part.

The toner cartridge 9 includes a toner containing unit 33 as a second developer containing unit for a toner. Further, the toner containing unit 33 has a supplying outlet (supplying port) 34 corresponding to the supplied port 16*a*. The toner containing unit 33 internally includes a screw 38 on the upper side of the supplying port 34, where the screw 38 as a developer conveying member conveys and supplies the toner. The screw 38 receives a driving power (not illustrated) from the apparatus body A and rotates to convey the toner in the toner containing unit 33 to the supplying port 34. Then, the screw 38 supplies the toner to the supplied port 16*a*.

The toner containing unit 33 internally includes a toner feeding member 36*a-b* as a developer conveying member that feeds the toner to the screw 38. The toner feeding member 36*a-b* includes a conveyance sheet 36*b* connected with a shaft 36*a* to which a driving power is applied for rotation. By the rotation of the shaft 36*a*, the conveyance sheet 36*b* feeds the toner to the screw 38.

Further, the supplying port 34 includes a supply opening shutter part 35, which opens the supplying port 34 when the toner cartridge 9 is used and closes the supplying port 34 when the toner cartridge 9 is not used.

Figure 3:
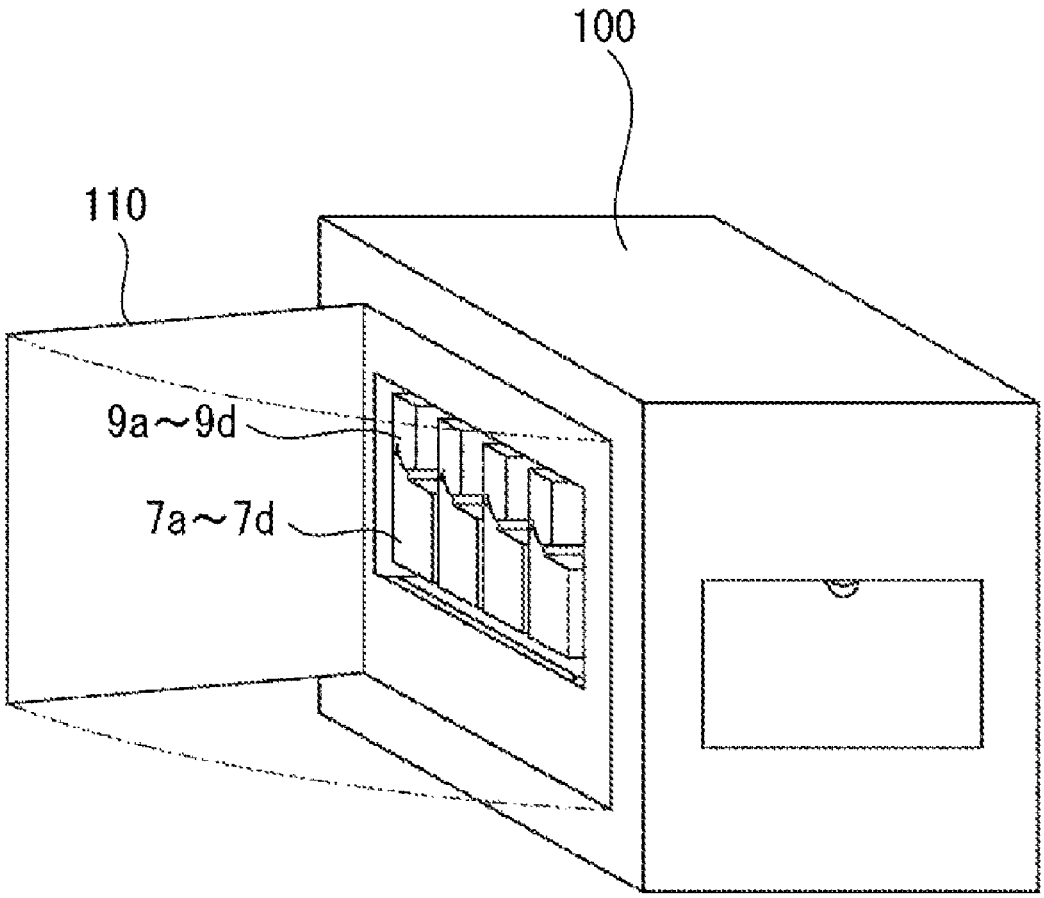
FIG. 3 is a perspective view to illustrate a process cartridge and a toner cartridge inserted into an electrophotographic color image forming apparatus according to the first exemplary embodiment of the present invention.

Then, the configuration for attaching the process cartridge 7 and the toner cartridge 9 to the apparatus body A will be described with reference to FIG. 3.

A cartridge cover 110 provided at the apparatus body A is opened and the process cartridge 7 and the toner cartridge 9 are inserted into the apparatus body A along a length direction of the cartridges 7 and 9. The driving power is input to the cartridges 7 and 9 at the back of the apparatus body A in the insertion direction.

In order to attach the toner cartridge 9 to the apparatus body A, as illustrated in FIGS. 2A and 2B, the apparatus body A includes body rails 101*a* and 101*b* for guiding guides 42*a* and 42*b* provided at the toner cartridge 9. The toner cartridge 9 is attachable and detachable by inserting/pulling it out while the guides 42*a* and 42*b* are placed on the body rails 101*a* and 101*b*.

Further, in order to attach the process cartridge 7 to the apparatus body A, as illustrated in FIGS. 2A and 2B, the apparatus body A includes body rails 102*a* and 102*b* for guiding guides 43*a* and 43*b* provided at the process cartridge 7. The process cartridge 7 is attachable and detachable by inserting and pulling it out while the guides 43*a* and 43*b* are placed on the body rails 102*a* and 102*b*.

Next, a portion near the shutter part 35 for opening and closing the supplying port 34 of the toner cartridge 9 according to this embodiment will be described with reference to FIG. 4 to FIGS. 7A and 7B.

Figure 4:
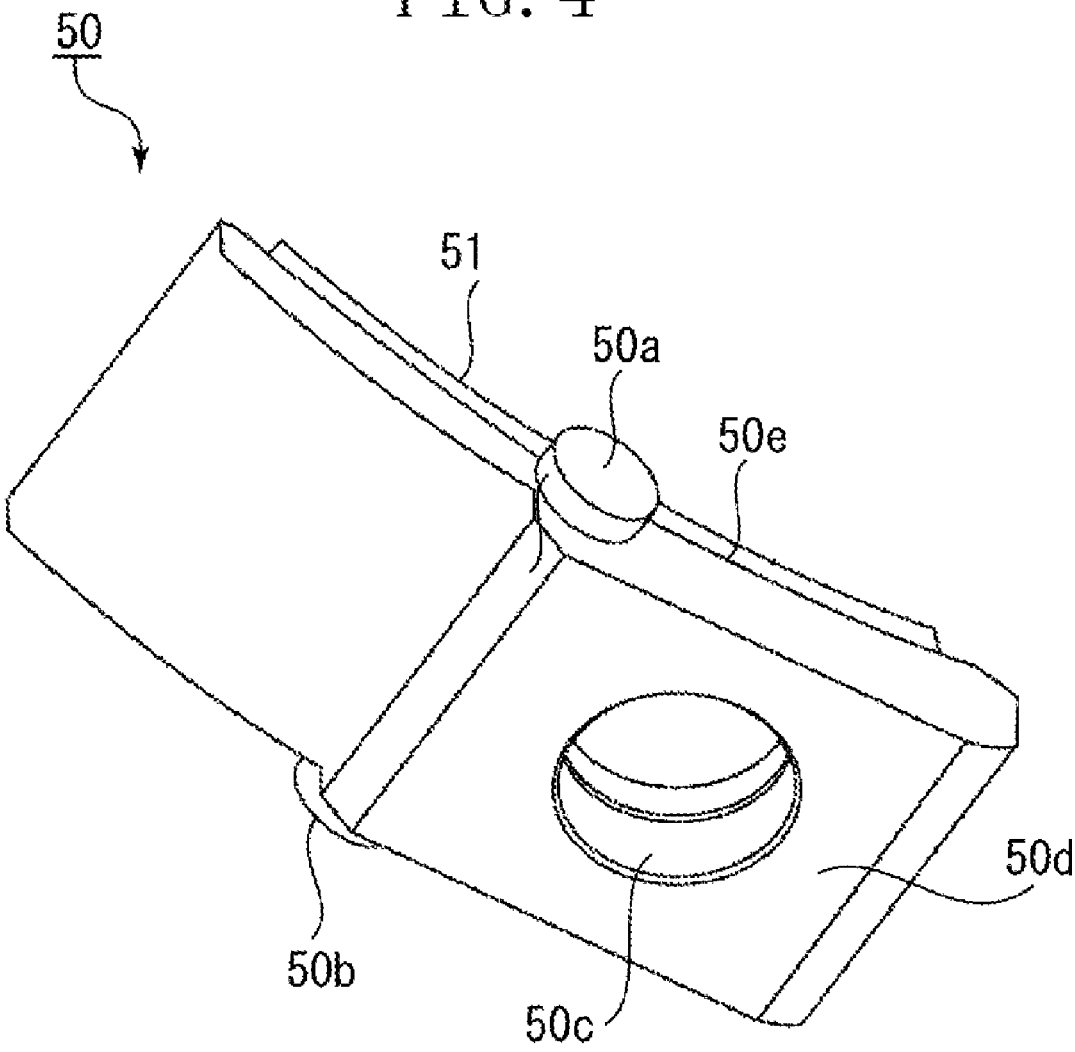
FIG. 4 is a perspective view of a supplying outlet member according to the first exemplary embodiment of the present invention.

FIG. 4 is a perspective view to illustrate a supplying port member 50 having a supplying port 50*c* for supplying a toner to the toner container 16 from the toner containing unit 33. The supplying port member 50 is capable of swinging and has swinging shafts 50*a* and 50*b* which are centers of swing. In this embodiment, the swinging shafts 50*a* and 50*b* are rotatably provided at the toner cartridge 9. The supplying port 50*c* supplies the toner contained in the toner containing unit 33 to the toner supplied port 16*a*.

Further, the supplying port member 50 has a contact face 50*d*. The contact face 50*d* contacts the seal member 71 provided at the developing device 4. The contact face 50*d* may be made of a seal member such as foamed urethane or felt. Further, the supplying port member 50 includes a circular reception face 50*e*. A seal member 51 such as foamed urethane or felt is attached to the reception face 50*e*. In addition, a moving member 60 moves in contact with the reception face 50*e* so that the supplying port member 50 receives a force for swing.

Figure 5:
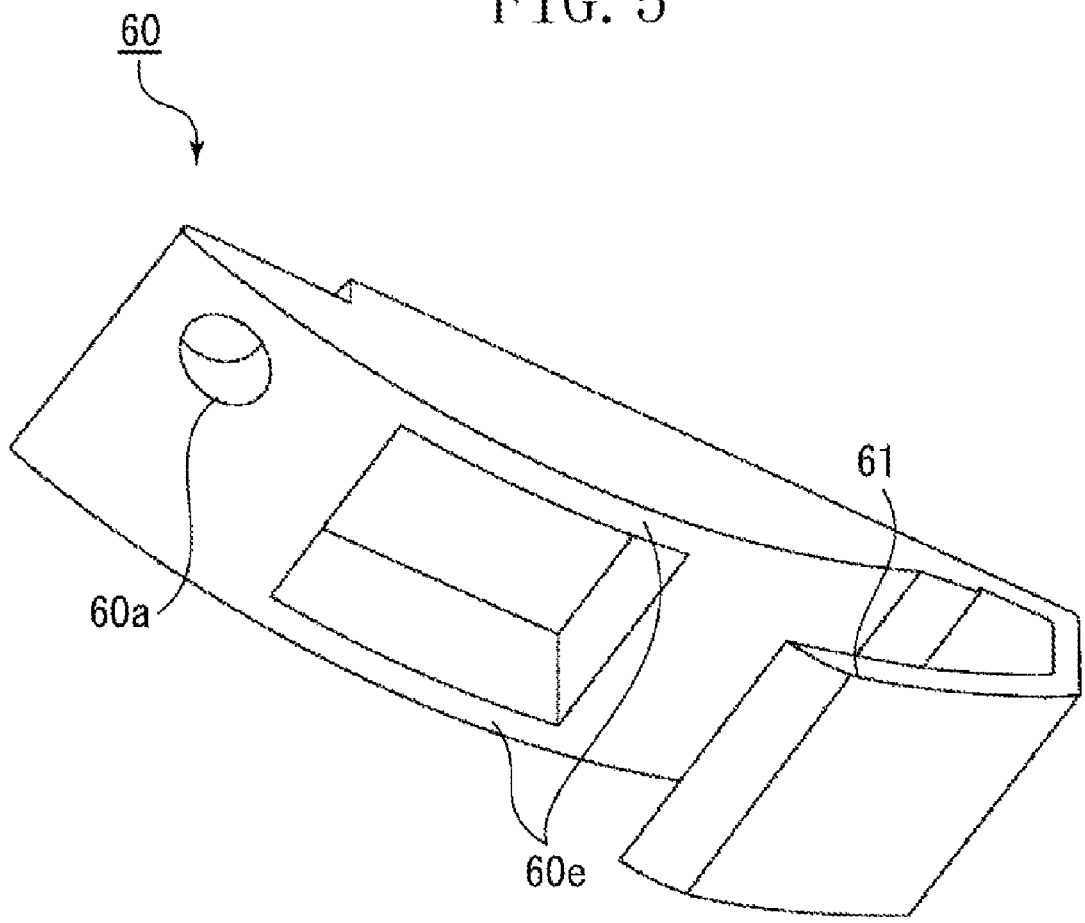
FIG. 5 is a perspective view of a moving member according to the first exemplary embodiment of the present invention.

FIG. 5 is a perspective view to illustrate the moving member 60 for swinging the supplying port member 50. The moving member 60 includes a drive face 60*e*. The drive face 60*e* has a circular shape having an approximately the same radius as that of the reception face 50*e*. The drive face 60*e* moves in contact with the reception face 50*e* to give a force to the supplying port member 50.

Further, a covering member 61 is integrally provided with the moving member 60. The covering member 61 moves along an outer wall 33*a* of the toner containing unit 33 and between a covering position shielding the supplying port 50*c* and a position exposing the supplying port 50*c* by retreating from the covering position.

In this embodiment, the covering member 61 and the moving member 60 are integrally configured. However, if an operation for making a phase difference in the timing for covering the supplying port 50*c* is performed when the moving member 60 moves, the moving member 60 and the covering member 61 may also be independently configured.

Next, the assembling and operation of the shutter part 35 with the supplying port member 50 and the moving member 60 will be described with reference to FIGS. 6, 7A, and 7B.

Figure 6:
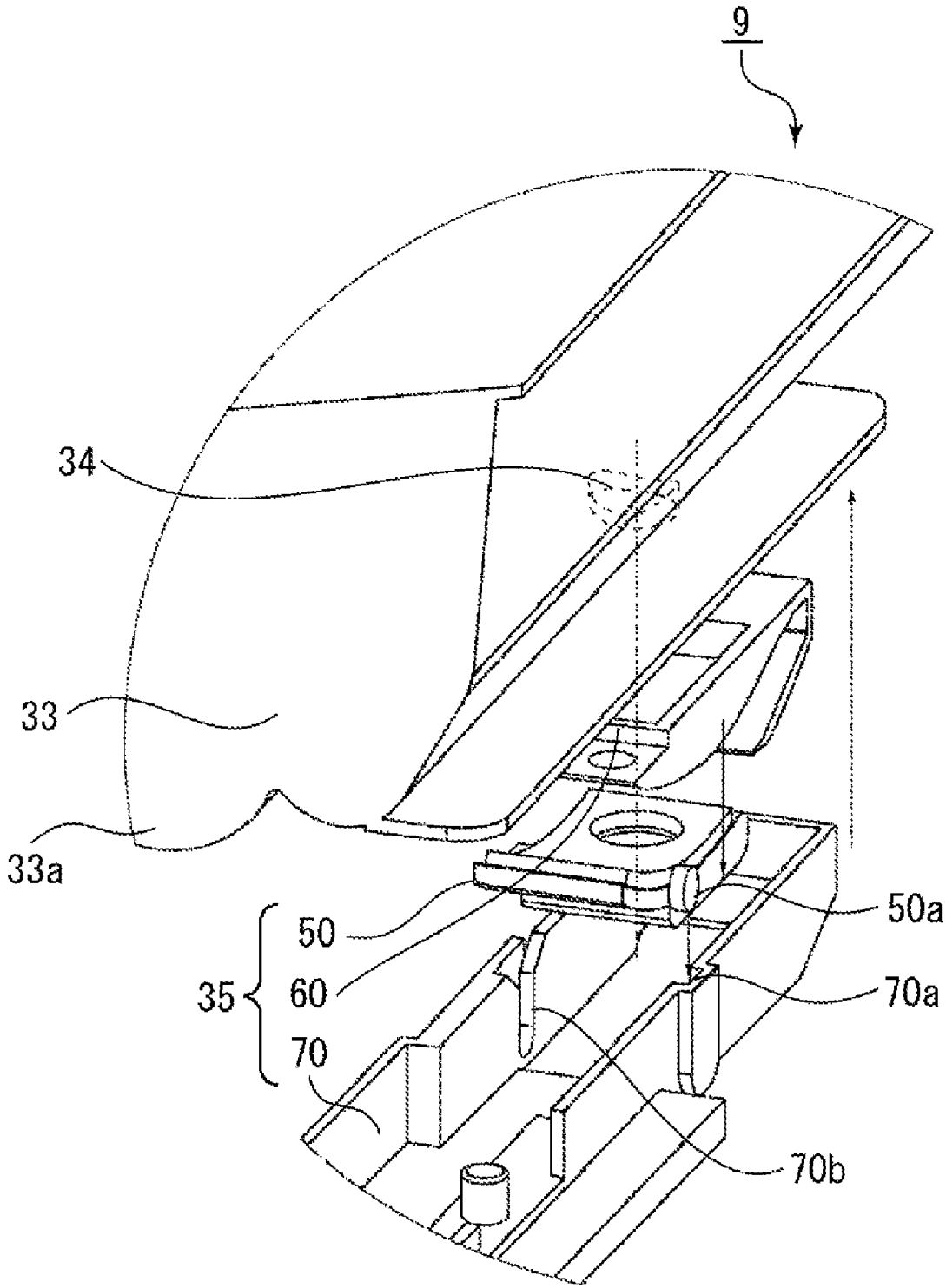
FIG. 6 is a perspective view to illustrate an assembling method of a shutter part in a toner cartridge according to the first exemplary embodiment of the present invention.

FIG. 6 is a perspective view to illustrate an assembling method for attaching the shutter part 35 to the toner cartridge 9. Swinging shafts 50*a* and 50*b* of the supplying port member 50 are configured to respectively fall into grooves 70*a* and 70*b* formed at a cover member 70 having the shutter part 35. Then, they are covered with the moving member 60 and the shutter part 35 is attached to the toner containing unit 33. Thus, the toner cartridge 9 is assembled, mounting the shutter part 35 thereon.

Figure 7A:
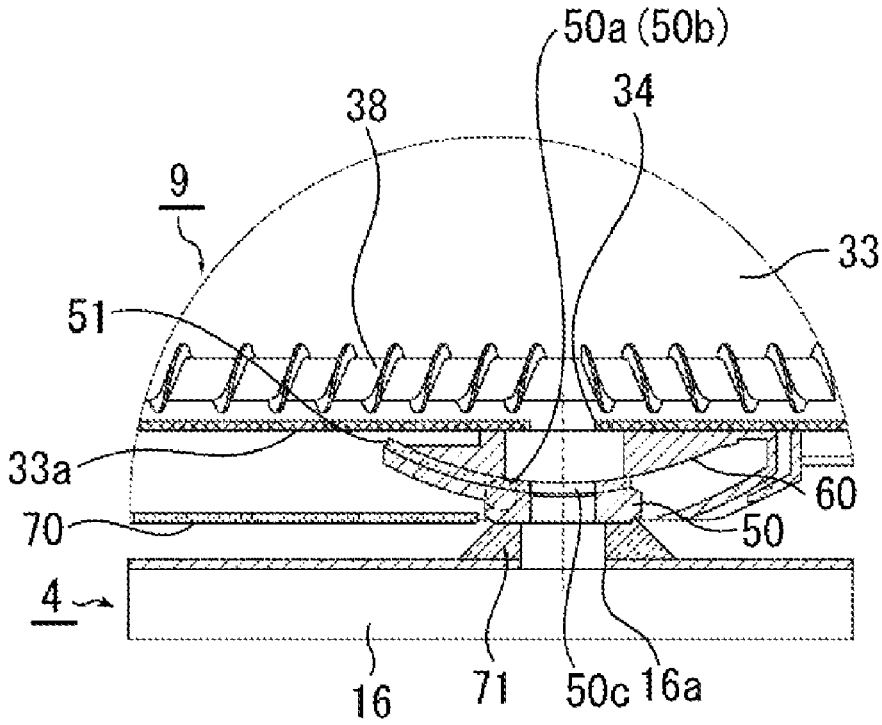
FIGS. 7A and 7B are cross sectional views to illustrate opened and closed states of a supplying part according to the first exemplary embodiment of the present invention.

FIG. 7(A) is a view to illustrate a state that the cartridges 7 and 9 are attached to the apparatus body A.

In FIG. 7 (A), when the cartridges 7 and 9 are attached, the toner supplying port 50*c* and the toner supplied port 16*a* are in a communicating state. Thus, when the screw 38 is rotated, the toner is conveyed to the supplying port 50*c*. Then, the toner falls from the supplied port 16*a* and is supplied to the developing device 4.

The seal member 71 such as foamed urethane or felt is pasted as an elastic member around the supplied port 16*a*. The seal member 71 is sandwiched between the cartridges 7 and 9 so that the upper face of the process cartridge 7 and the lower face of the toner cartridge 9 are kept in contact with each other so as to prevent scatter of the toner.

In a state where the toner can be supplied as illustrated in FIG. 7A, the covering member 61 retreats from the contact face 50*d*, at which the supplying port 50*c* is provided, to a position for exposing the supplying port 50*c*. Further, the contact face 50*d* is positioned at the supply position that contacts the seal member 71 in the developing device 4. The supplying position is the position where the supplying port 50*c* faces the toner supplied port 16*a* and the toner can be supplied from the supplying port 50*c* to the developing device 4 through the toner supplied port 16*a*.

The reception face 50*e* contacting the drive face 60*e* moves according to the movement of the moving member 60. By this movement, the supplying port member 50 swings around the swinging shafts 50*a* and 50*b*. By the swing of the supplying port member 50, the supplying port 50*c* can move between the supply position (FIG. 7A) where the toner can be supplied to the toner supplied port 16*a* and the non-supply position (FIG. 7B) where the toner is not supplied to the supplied port 16*a*.

Figure 7B:
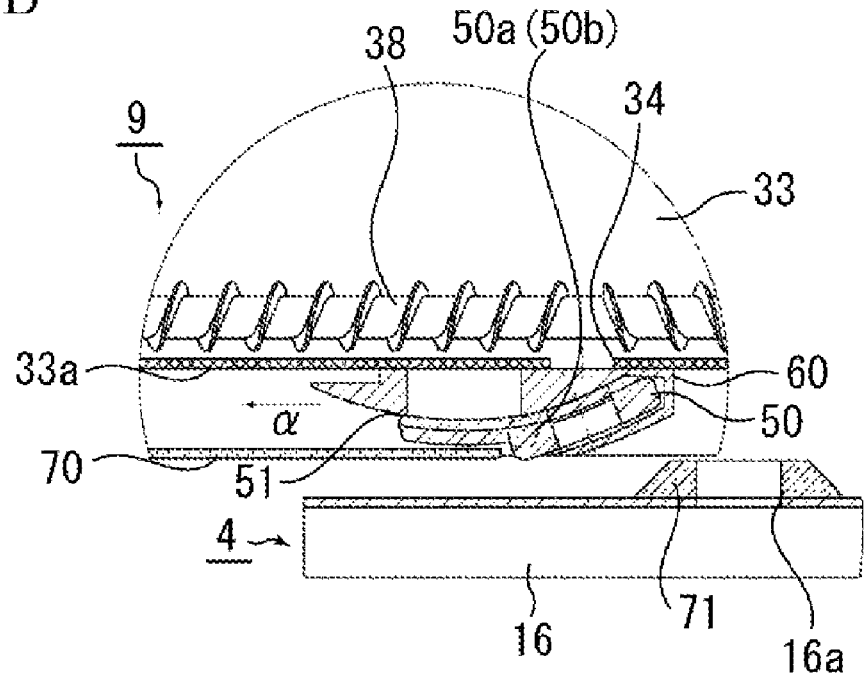

FIG. 7B is a view to illustrate a state that one of the toner cartridge 9 and the process cartridge 7 is detached from the apparatus body A. Here, a case of pulling out the toner cartridge 9 will be described below.

The moving member 60 in this embodiment is interlocked with attaching/detaching of the toner cartridge 9 or the process cartridge 7 by an operation unit and is capable of moving in parallel with an attaching/detaching direction. The configuration for moving the moving member 60 will be described further below. Further, in this embodiment, it is assumed that, when the toner cartridge 9 is pulled out, the moving member 60 moves in the same direction as the pulling-out direction of the toner cartridge 9.

When the toner cartridge 9 is pulled out in the state of FIG. 7A, the moving member 60 moves in a direction of an arrow cc in FIG. 7B in conjunction with the pulling-out. By this movement, the supplying port member 50 rotates counterclockwise around the swinging shafts 50*a* and 50*b* along the circular drive face 60*e* of the moving member 60. By this rotation, the contact face 50*d* moves upwardly from the side where the covering member 61 exists, and the contact face 50*d* separates from the seal member 71. At this time, as illustrated in FIG. 7B, the covering member 61 provided at the moving member 60 moves in the arrow α direction and moves to the position for covering the supplying port 50*c*.

As aforementioned, when the moving member 60 moves, the contact face 50*d* swings. As a consequence, the supplying port 50*c* moves to the non-supply position which is upwardly separated from the seal member 71. The non-supply position is a position retreating from the seal member 71 relative to the supply position.

Further, as illustrated in FIG. 7B, when the covering member 61 is at the covering position, the supplying port 34 of the toner containing unit 33 is covered with the moving member 60.

On the other hand, in a case of attaching the toner cartridge 9 to the apparatus body A, when the toner cartridge 9 is inserted, the moving member 60 moves in the opposite direction of the arrow α in FIG. 7B. By this movement, as illustrated in FIG. 7A, the supplying port member 50 moves from the non-supply position to the supply position. Further, the covering member 61 retreats from the contact face 50*d* and moves to the position for exposing the supplying port 50*c*. As a consequence, the contact face 50*d* contacts the seal member 71 and the supplying port 50*c* is exposed to face the supplied port 16*a*. Thus, the supplying port 34 is communicated with the supplying port 50*c*.

Figure 8:
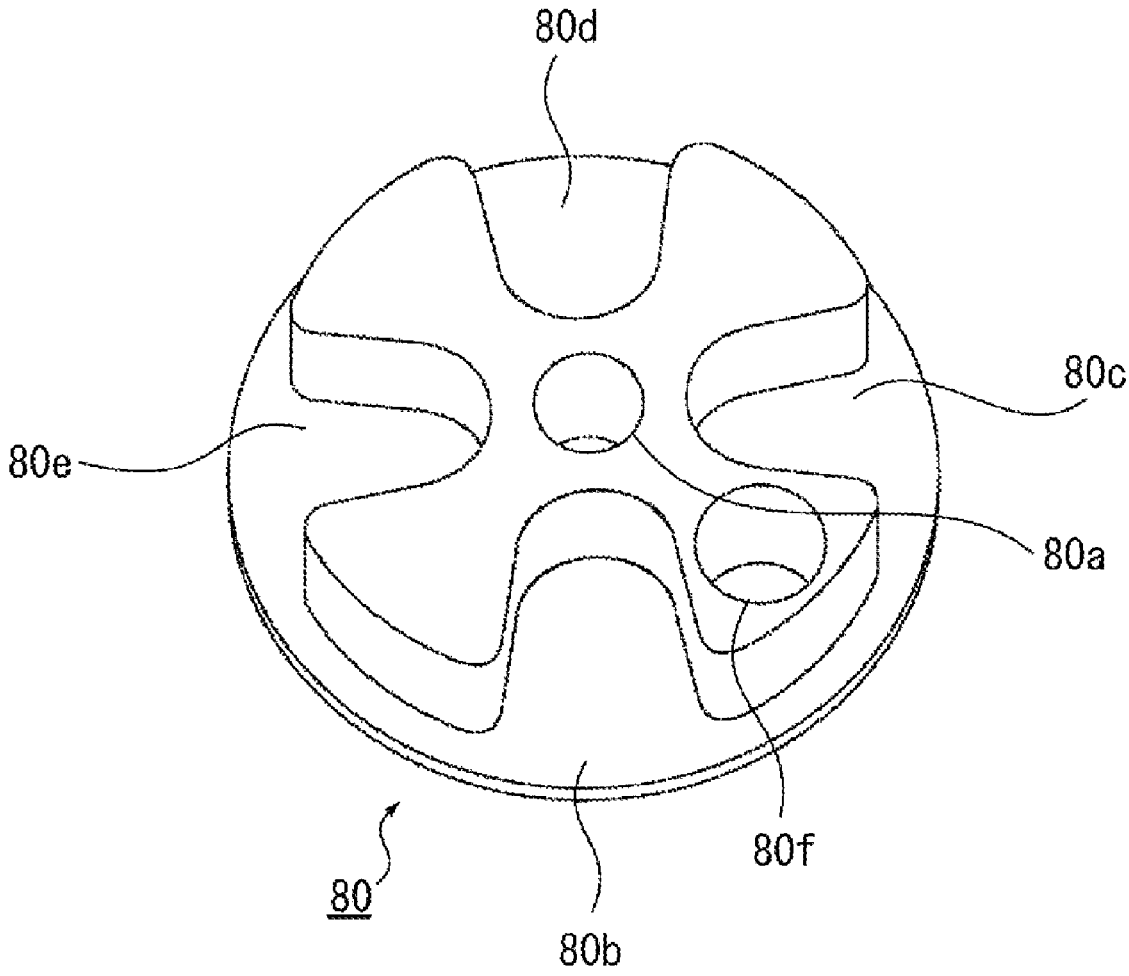
FIG. 8 is a perspective view to illustrate a rotation member according to the first embodiment.

Then, a moving operation of the covering member 61 and the moving member 60 will be described with reference to FIGS. 8 and 9.

The toner cartridge 9 includes an operation unit for moving the covering member 61 when the toner cartridge 9 is attached to or detached from the apparatus body A. As illustrated in FIG. 8, the operation unit in this embodiment is a rotation member 80 and a crank shaft 81. The rotation member 80 is rotatably attached to the toner cartridge 9 and the crank shaft 81 is engaged with the rotation member 80.

The rotation member 80 includes a rotation center 80*a*, and four grooves 80*b*, 80*c*, 80*d*, and 80*e* which are radially formed from the center in the four directions. The rotation member 80 further includes a second hole part 80*f* between the grooves 80*b* and 80*c*.

Figure 9:
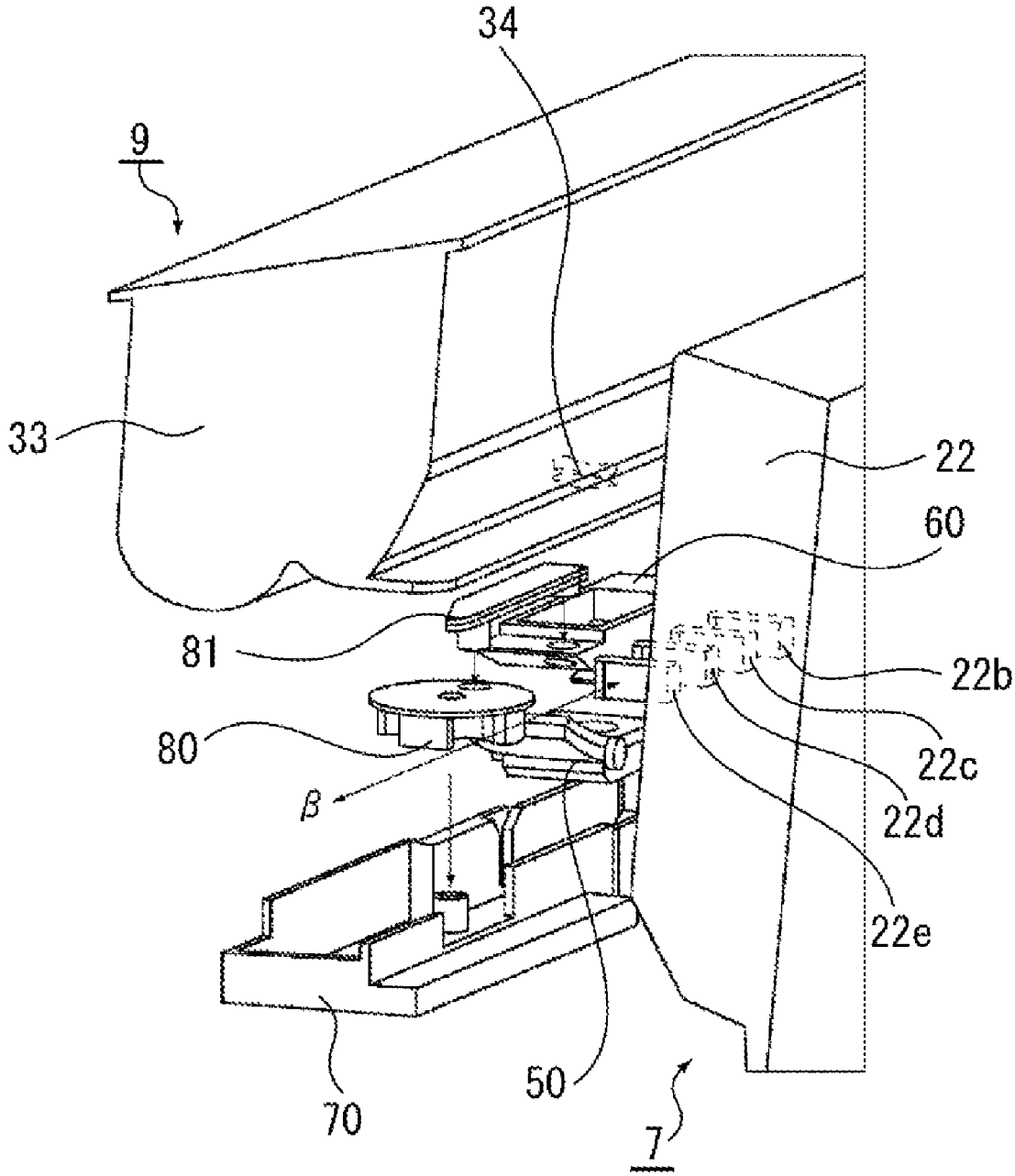
FIG. 9 is a perspective view to illustrate an assembling method of a driving part according to the first exemplary embodiment of the present invention.

FIG. 9 is a perspective view to illustrate a method for assembling the shutter part 35 and the rotation member 80. The moving member 60 includes a drive hole part 60*a* (see FIG. 5). The second hole part 80*f* and the drive hole part 60*a* are connected with the crank shaft 81.

Further, the process cartridge 7 includes four projections 22*b*, 22*c*, 22*d*, and 22*e* as an operation unit for moving the moving member 60. The four projections 22*b*, 22*c*, 22*d*, and 22*e* move in a direction of the arrow β in FIG. 9 according to the relative positional relation with the toner cartridge 9.

Figure 10:
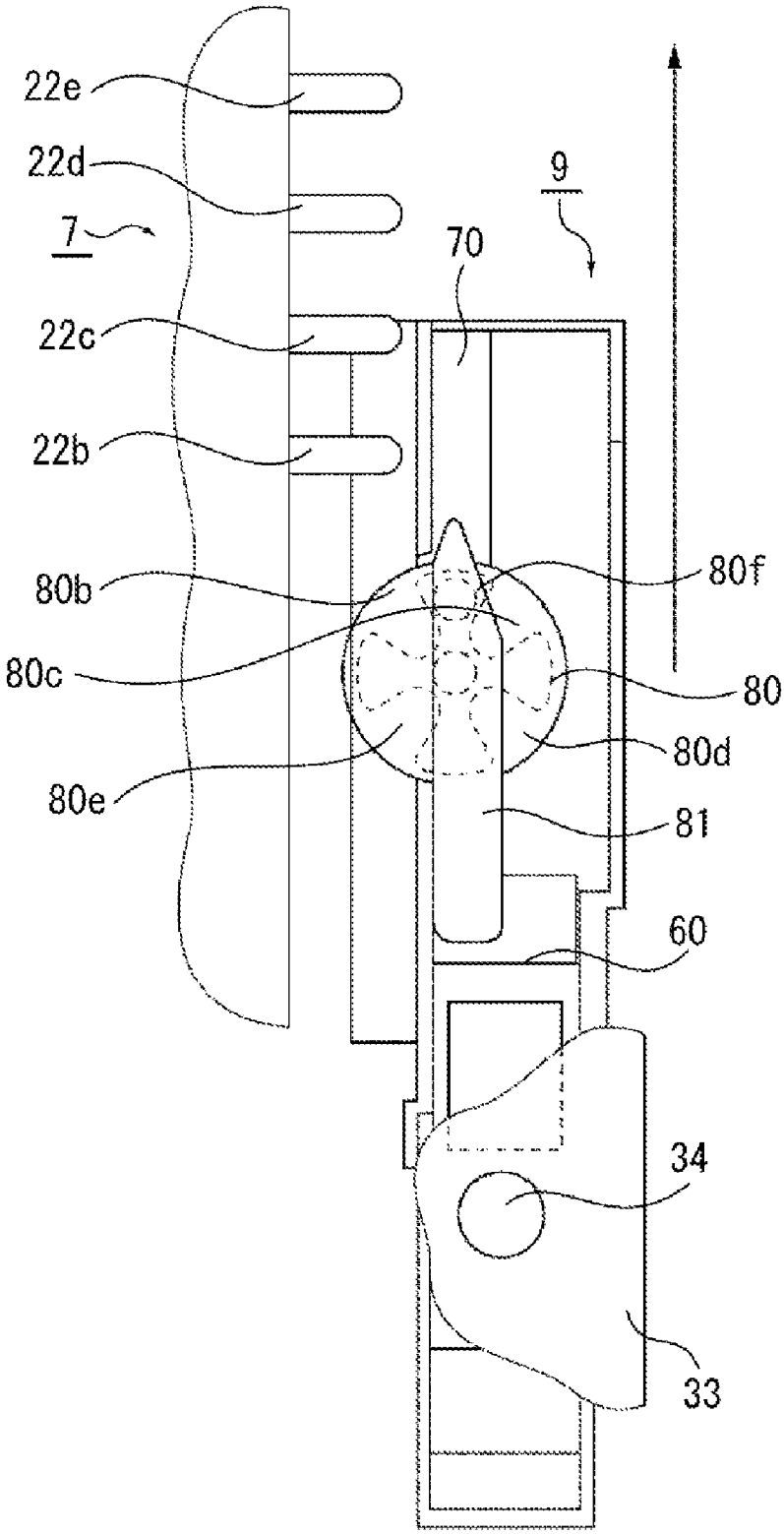
FIG. 10 is a view to illustrate movement of a driving part and a supplying part according to the first exemplary embodiment of the present invention.

Next, a moving operation of the moving member 60 in the toner cartridge 9 is described with reference with FIG. 10 to FIG. 12.

At first, attaching/detaching of the toner cartridge 9 when the process cartridge 7 is attached will be described. In this embodiment, an example will be described in which the moving member 60 moves in a direction reverse to the attaching/detaching direction when the toner cartridge 9 is attached.

Naturally, the attaching/detaching direction of the toner cartridge 9 and the moving direction of the moving member 60 can be set also in the same direction.

When the process cartridge 7 is attached, the projections 22*b* and 22*c* are in a state of waiting in the apparatus body A, and the toner cartridge 9 is inserted in the arrow direction in this state. At this time, the rotation member 80 is in a state illustrated in FIG. 10.

The guide parts 42*a* and 42*b* of the toner cartridge 9 are placed on the guides 101*a* and 101*b* illustrated in FIGS. 2A and 2B, so that the toner cartridge 9 is inserted in the length direction while keeping its attitude. By this insertion, grooves 80*b* and 80*c* formed at the rotation member 80 are subjected to an action from the projections 22*b* and 22*c* of the process cartridge 7.

Figure 11:
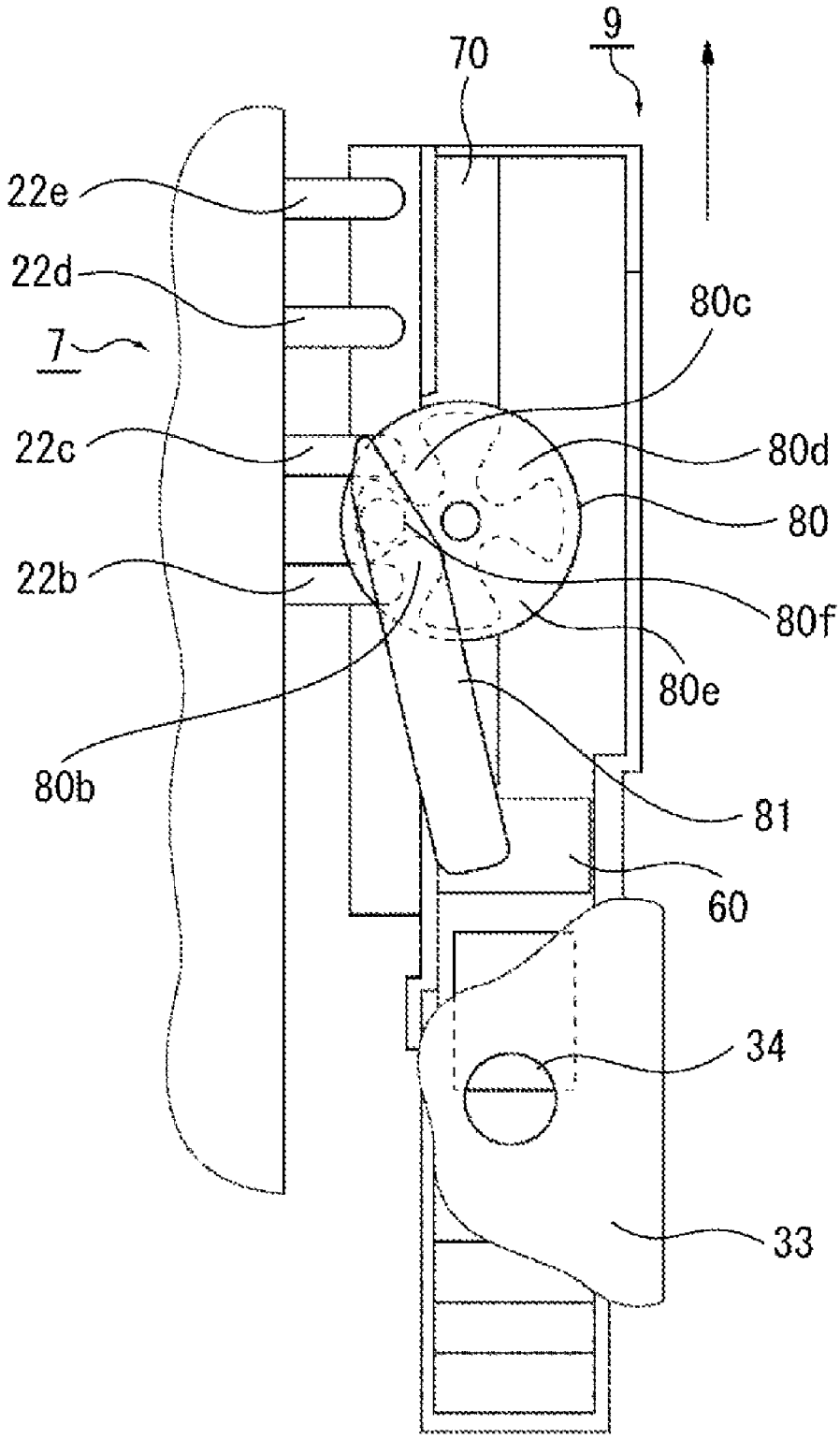
FIG. 11 is a view to illustrate movement of a driving part and a supplying part according to the first exemplary embodiment of the present invention.
Figure 12:
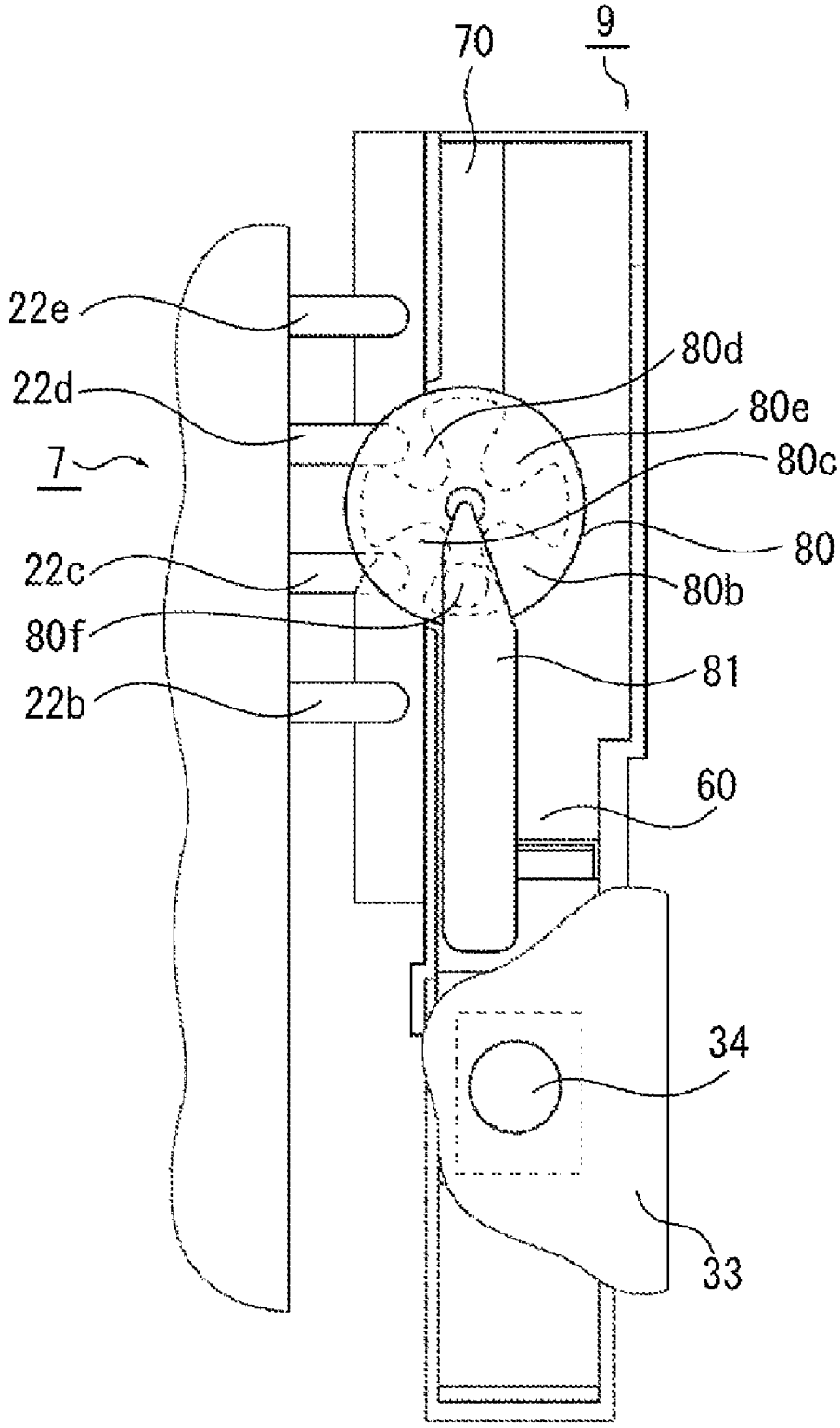
FIG. 12 is a view to illustrate movement of a driving part and a supplying part according to the first exemplary embodiment of the present invention.

As illustrated in FIGS. 11 and 12, the rotation member 80 is rotated owing to the above action. The rotation member 80 is rotated approximately 90 degrees for every one projection that passes (see FIG. 11).

It is when the grooves 80*b* and 80*c* pass two projections 22*b* and 22*c* that the positions of the supplying port 50*c* and the supplied port 16*a* approximately match. When the rotation member 80 is rotated approximately 180 degrees (see FIG. 12), the toner cartridge 9 and the process cartridge 7 are placed at positions where they are attached to the image forming apparatus 100.

At this time, since the rotation member 80 rotates approximately 180 degrees, the crank shaft 81 moves, and thus one end of the crank shaft 81 is pushed. Thus, the moving member 60 moves linearly while both side faces are regulated.

Thus, the covering member 61 is moved from the covering position to the exposing position by moving the moving member 60 linearly. In conjunction with this action, the supplying port 50*c* of the supplying port member 50 moves from the non-supply position to the supply position. As a result of this movement, the supplying port 50*c* is exposed. At the same time, the seal member 71 of the developing device 4 contacts the contact face 50*d*.

Further, when the toner cartridge 9 is pulled out, the rotation member 80 rotates approximately 180 degrees in a reverse direction to the aforementioned direction to move the moving member 60. By this movement, the supplying port member 50 moves to the non-supply position to cover the supplying port 50*c* with the covering member 61. Accordingly, the supplying port member 50 moves from the supply position to the non-supply position in conjunction with the covering member 61 which moves from the exposing position to the covering position. The covering member 61 is integrated with the moving member 60.

In order to match the attaching/detaching direction of the toner cartridge 9 with the moving direction of the moving member 60, a relation of the rotation member 80 and the crank shaft 81 before attaching the toner cartridge 9 to the apparatus body A is configured to be in a state illustrated in FIG. 12. In that state, when the toner cartridge 9 is attached and the rotation member 80 rotates approximately 180 degrees, the moving member 60 moves in a direction for attaching the toner cartridge 9. Further, when the toner cartridge 9 in an attached state is pulled out, the rotation member 80 rotates approximately 180 degrees again. Thus, the moving member 60 moves in a direction for pulling out the toner cartridge 9.

Now, a sequence for eliminating toner aggregation will be described.

When the toner cartridge 9 is put in physical distribution or stored under high temperature and high humidity conditions, a toner in a container may clump.

Particularly, the aggregation near the supplying port 34 in the toner cartridge 9 can be hardly broken even by driving and rotating the screw 38 and the conveyance sheet 36*b* if the aggregation is not within a rotation range. Further, the aggregation cannot fall only by a weight of the toner itself.

If supplying of the toner continues in such a state, a predetermined amount of the toner cannot be fed to the toner supplied port 16*a* of the process cartridge 7, and thus the toner runs short near the developing roller 17 so that disappearance of an image may occur.

Now, a method for eliminating the aggregation of the toner around the supplying port 34 of the toner cartridge 9 by giving vibration to the developing container 18 will be described below.

The cam 21 as a vibration applying member is moved (see FIG. 13) after the toner cartridge 9 is attached to the apparatus body A and before a driving power is transmitted to the screw 38 and the toner feeding member 36*a-b* (in a state where a screw 38 and a toner feeding member 36*a-b* are stopped). In this embodiment, the cam 21 is moved receiving a force from a coupling part 203 serving as a drive transmission part provided in the apparatus body A. Further, the developing device 4 has a drive receiving part 200 for receiving a drive from the apparatus body A and has a gear group including gears 200*b*, 201, and 202. By receiving a driving power from the coupling part 203, a coupling part 200*a* in the drive receiving part 200 rotates the cam 21 via the gears 200*b*, 201, and 202. Thus, the cam 21 moves from a first cam position to a second cam position by receiving the force from the apparatus body A. Accordingly, the developing container 18 moves from the state in FIG. 2A to the state in FIG. 2B against an urging force of the spring 24. As a result, the toner cartridge 9 is displaced from a first position to a second position. Then, the cam 21 moves from the second cam position to the first cam position. Thus, the developing container 18 moves from the state of FIG. 2B to the state of FIG. 2A under an urging force of a spring 24. As a result, the toner cartridge 9 is displaced from the second position to the first position. Accordingly, by driving and rotating the cam 21 in the process cartridge 7 between the first cam position and the second cam position, the toner cartridge 9 is vibrated a plurality of times via the developing container 18.

As a result, vibration is applied to a portion around the supplying port 34 of the toner cartridge 9 via the seal member 71. That is, the developing device 4 is vibrated by swinging the cam 21, and the toner cartridge 9 is vibrated via the developing device 4. In this way, the toner around the supplying port 34 is broken and can fall into the toner supplied port 16*a* of the process cartridge 7. In this embodiment, to eliminate the aggregation of the toner, the cam 21 is used as a contacting/separating member for contacting and separating the developing roller 17 and the photosensitive drum 1. Therefore, it is not necessary to add a new member for eliminating the aggregation of the toner.

In this embodiment, the cam 21 swings in a state where the screw 38 and the conveyance sheet 36*b* as the conveying members are stopped. When the screw 38 or the conveyance sheet 36*b* are driven together with the cam 21 at the same time, the toner is fed to a portion near the supplying port 34 before the toner near the supplying port 34 is broken and falls into the toner supplied port 16*a*. As a consequence, less aggregation occurs. According to the present embodiment, the aforementioned troubles can be avoided.

Next, timing for giving vibration to the developing container 18 will be described.

A new toner cartridge 9 tends to generate the aggregation of the toner just after distribution or under an influence of storage.

Figure 14:
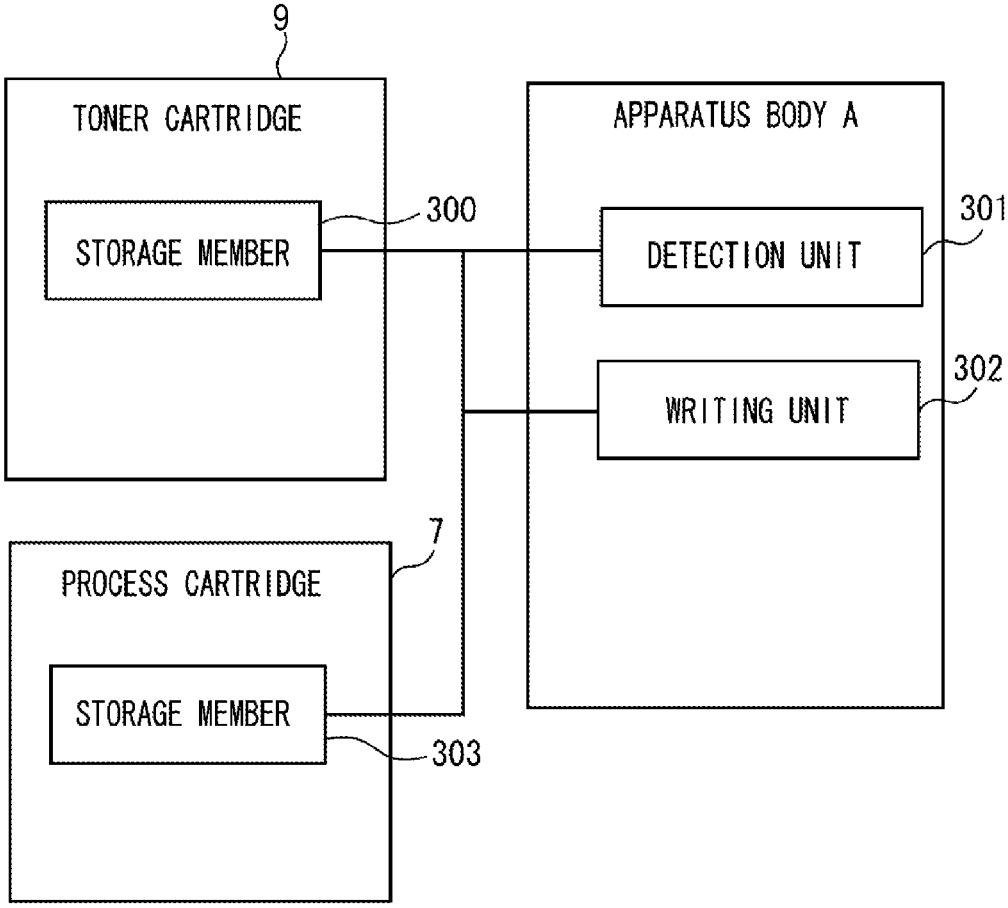
FIG. 14 is a block diagram of a toner cartridge, a process cartridge, and an apparatus body.

Thus, as illustrated in FIG. 14, the toner cartridge 9 includes a storage member 300 to be detected. The apparatus body A includes a detection unit 301 and a writing unit 302 as detection members. The detection unit 301 detects predetermined information stored in the storage member 300. The writing unit 302 writes the predetermined information to the storage member 300. In this embodiment, when the toner cartridge 9 is attached to the apparatus body A, the detection unit 301 detects the storage member 300 so that it is confirmed whether a predetermined vibration applying operation to the toner cartridge 9 is completed. When the detection unit 301 detects that the predetermined vibration applying operation is not completed, the cam 21 is rotationally driven to give vibration to the developing container 18. As for a member to be detected, a nonvolatile memory member is used. When the predetermined vibration applying operation is completed, the writing unit 302 writes the information that the predetermined vibration applying operation is completed into the storage member 300 (the memory member). In this way, time loss, caused by giving vibration to the toner cartridge 9 again in which the predetermined vibration applying operation is already completed, can be solved. In addition, one example of the aforementioned information whether the predetermined vibration applying operation is completed may also be whether the toner cartridge 9 is a new one.

Figure 15A:
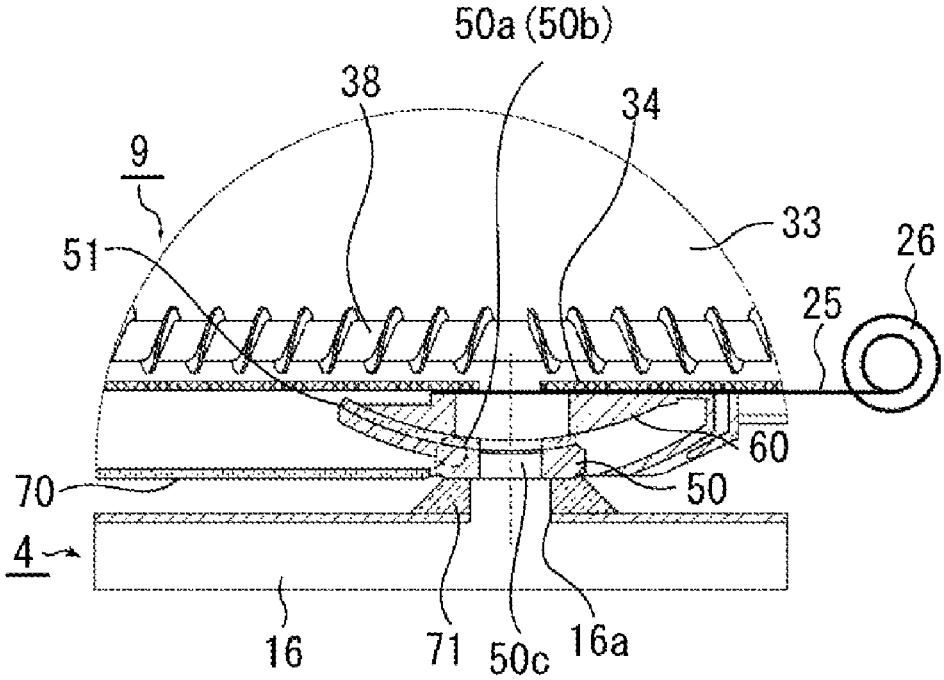
FIGS. 15A and 15B are cross sectional views of a toner supplying part and a toner supplied part according to the first exemplary embodiment of the present invention.
Figure 15B:
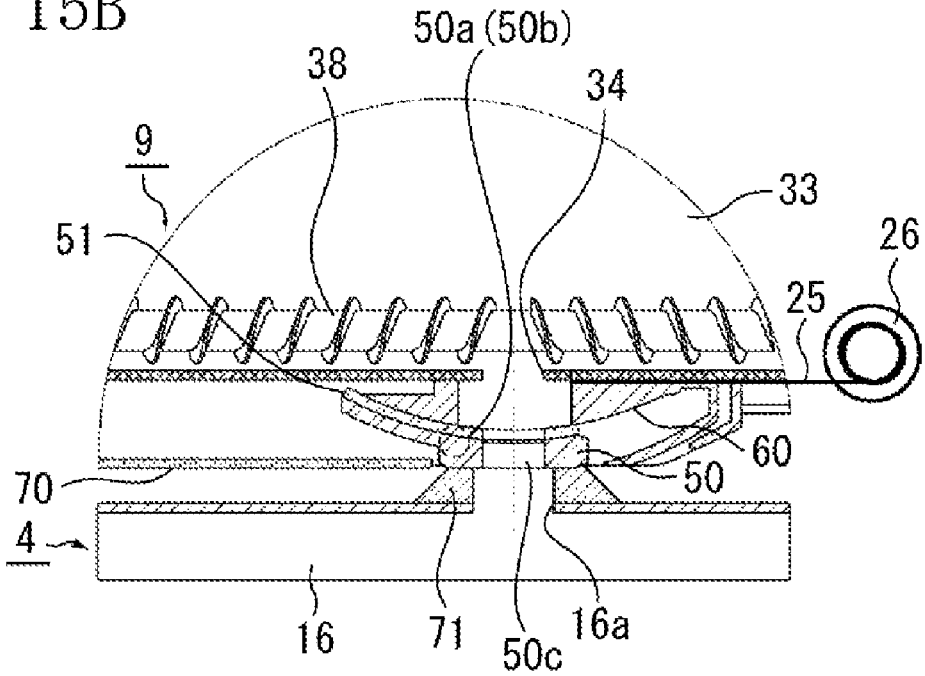
Figure 16:
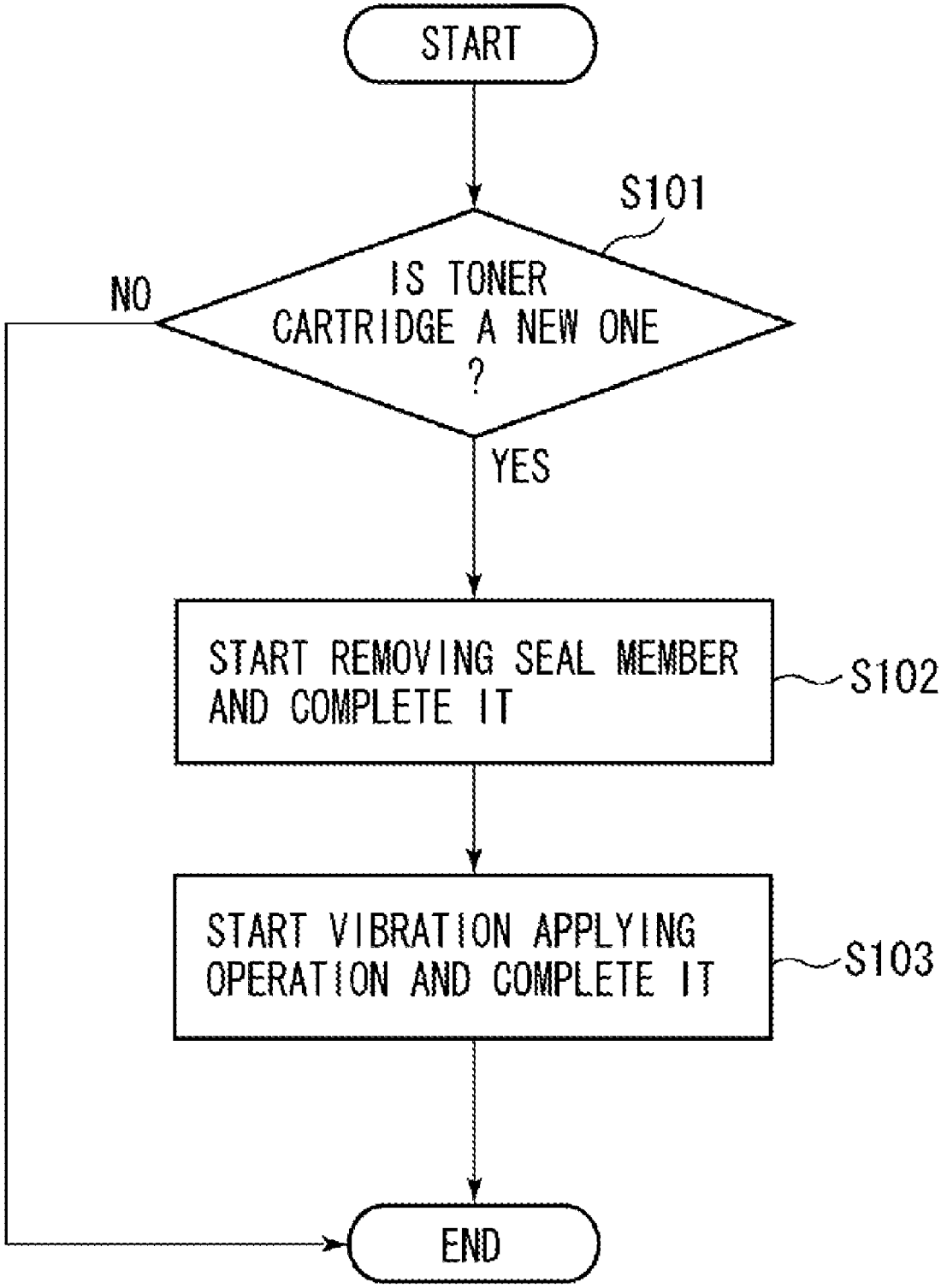
FIG. 16 is a flowchart of a vibration applying sequence according to the first exemplary embodiment of the present invention.

FIG. 16 is a flowchart of the vibration applying sequence when a removable seal member 25 is attached to an opening part of a new toner cartridge 9, as illustrated in FIGS. 15A and 15B.

In this case, the toner cartridge 9 is attached to the apparatus body A. In step S101, the detection unit 301 determines whether the toner cartridge 9 is a new one. When the toner cartridge 9 is a new one (YES in step S101), the drive unit (not illustrated) of the apparatus body A removes the seal member 25 by the drive transmission member in step S102. Then, the apparatus body A gives vibration to the developing container 18 in step S103. At this time, a winding member 26 for winding the seal member 25 is provided in the toner cartridge 9. The winding member 26 receives the driving force from the apparatus body A and rotates to remove the seal member 25 from the supplying port 34.

In this embodiment, vibration is applied to the developing container 18 after the seal member 25 is winded. Thus, when the vibration is applied, the broken toner can escape to the supplying port 50*c*. When the detection unit 301 does not detect that the toner cartridge 9 is a new one, the winding member 26 does not wind the seal member 25.

Figure 17A:
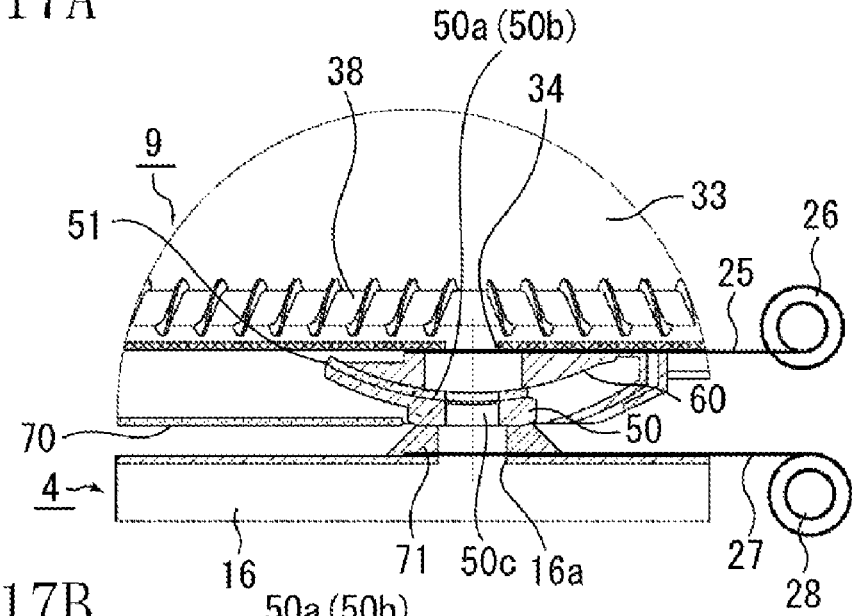
FIGS. 17A to 17C are cross sectional views of a toner supplying part and a part receiving the toner according to the first exemplary embodiment of the present invention.
Figure 17B:
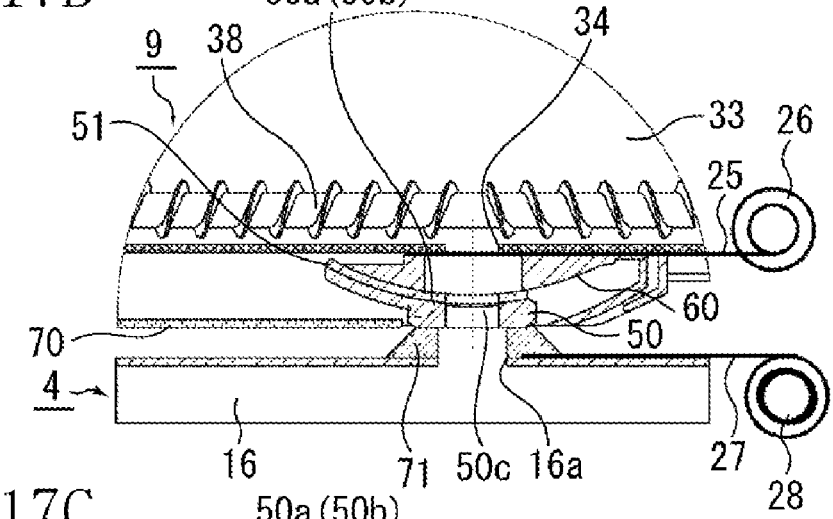
Figure 17C:
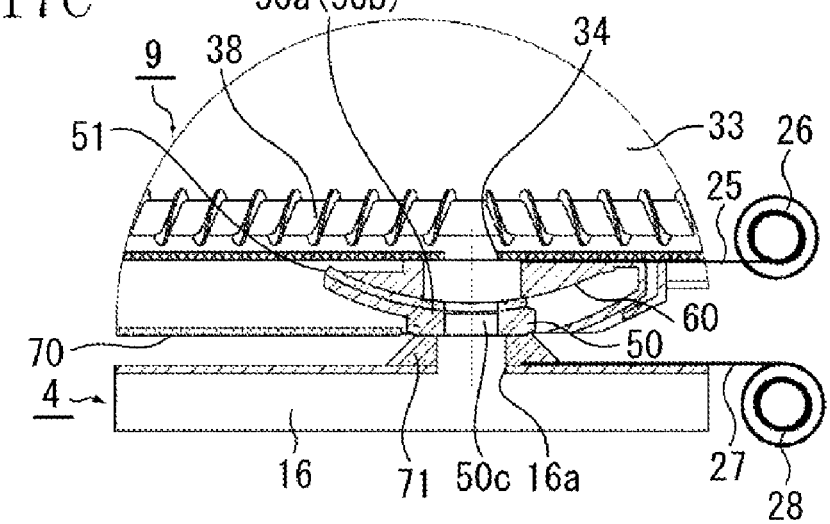
Figure 18:
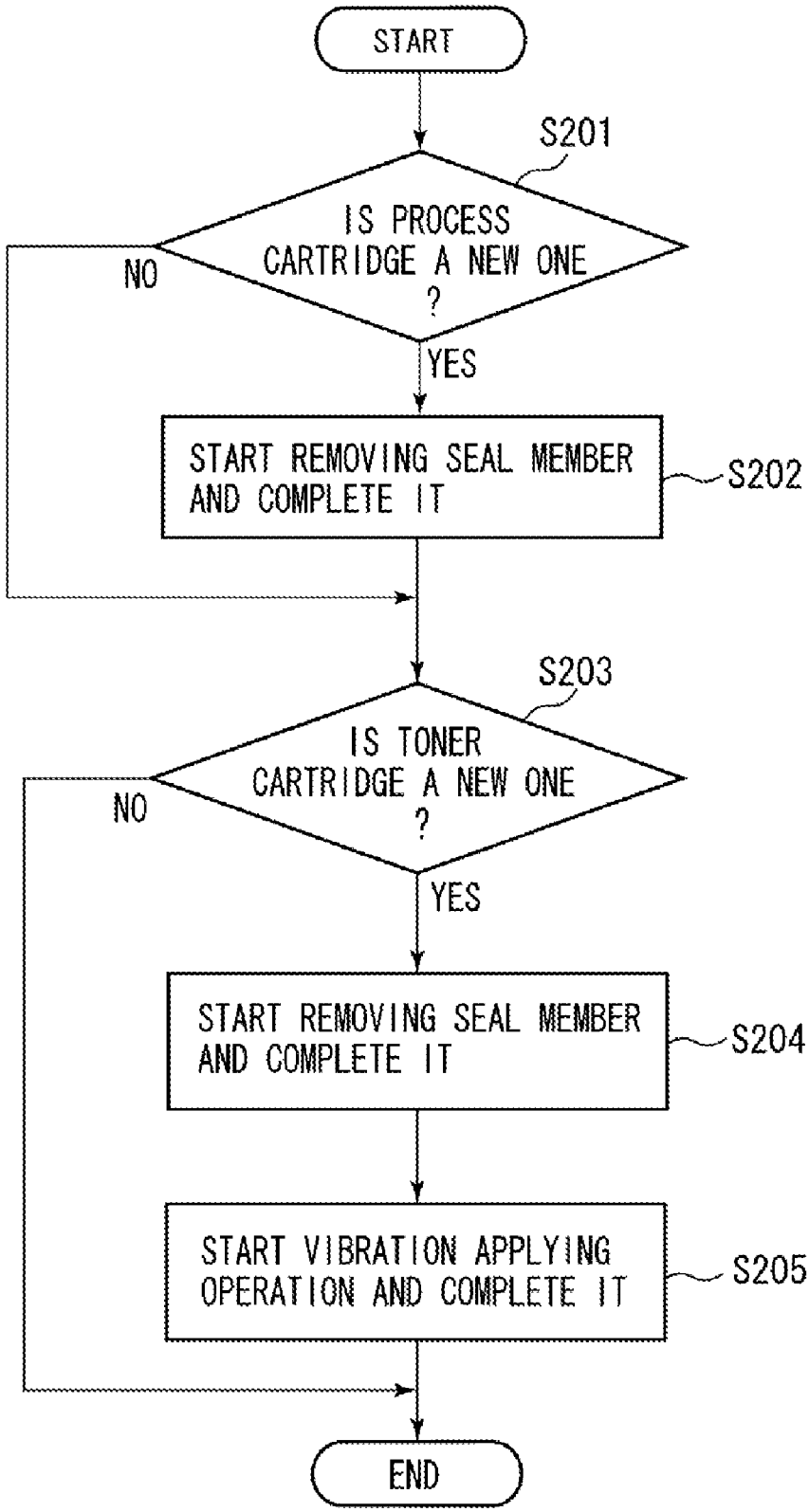
FIG. 18 is a flowchart of a vibration applying sequence according to the first exemplary embodiment of the present invention.

Then, referring to FIGS. 17A to 17C, the detection unit 301 detects that both the toner cartridge 9 and the process cartridge 7 are new ones. FIGS. 17A to 17C show a state where both seal members 25, 27 are attached, up to a state where the seal members 25, 27 of both cartridges 9, 7 are being reeled off. FIG. 18 is the flowchart of the vibration applying sequence at this time.

In step S201, the detection unit 301 detects information stored in a storage member 303 to determine whether the process cartridge 7 is a new one. When the process cartridge 7 is a new one (YES in step S201), the apparatus body A reels off the seal member 27 from the process cartridge 7 to wind it around a winding member 28 in step S202. Then, in step S203, the detection unit 301 detects information stored in the storage member 300 to determine whether the toner cartridge 9 is a new one. If it is detected that the toner cartridge 9 is a new one (YES in step S203), in step S204, the apparatus body A reels off the seal member 25 from the toner cartridge 9 to wind it around the winding member 26. In step S205, the apparatus body A gives vibration to the developing container 18. Thus, the toner broken in the toner cartridge 9 can escape into the process cartridge 7.

Figure 19:
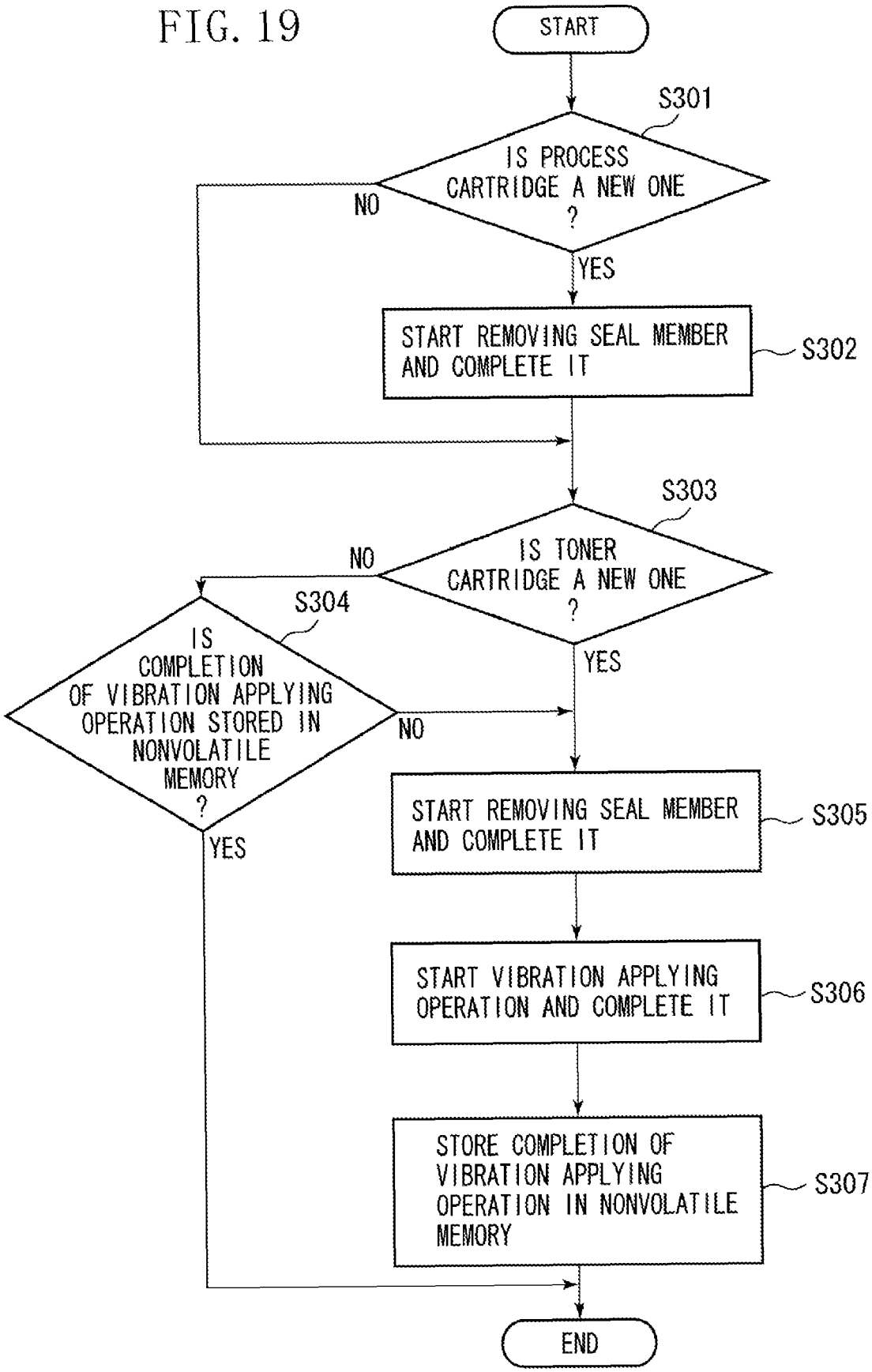
FIG. 19 is a flowchart to illustrate recording the completion of applying of vibration in a vibration applying sequence according to the first embodiment of the present invention.

FIG. 19 is the flowchart of a vibration applying sequence in a case of storing information whether a predetermined vibration operation is completed in the storage member 300. The flowchart illustrates a measure against a case where a power is turned off in the middle of a process for giving the vibration to the developing container 18.

In step S301, the detection unit 301 detects information stored in the storage member 303 to determine whether the process cartridge 7 is a new one. When the process cartridge 7 is a new one (YES in step S301), the apparatus body A reels off the seal member 27 in the process cartridge 7 by the drive transmission unit in step S302. Then, in step S303, the detection unit 301 detects information stored in the storage member 300 to determine whether the toner cartridge 9 is a new one. When the toner cartridge 9 is not a new one (NO in step S303), the apparatus body A reads information stored in the storage member 300 and determines whether a predetermined vibration applying operation is completed, in step S304. When the predetermined vibration applying operation is completed (YES in step S304), it is not necessary to newly add vibration, so that the processing ends. On the other hand, when either the predetermined vibration applying operation is not completed (NO in step S304) or the toner cartridge 9 is a new one (YES in step S303), the apparatus body A removes the seal member 25 from the toner cartridge 9 in step S305. Then, in step S306, the apparatus body A gives vibration to the developing container 18. In step S307, the apparatus body A writes information that the predetermined vibration applying operation is completed into the storage member 300 using the writing unit 302. Accordingly, the apparatus body A gives a vibration to the developing container 18 only when required.

Therefore, at a time of attaching the toner cartridge 9 to the apparatus body A, even when the detection member detects that the toner cartridge 9 is not a new one, the apparatus body A removes the seal member 25 and gives a vibration to the developing container 18 again if the information that a predetermined swing operation of the cam 21 is completed is not stored in the storage member 300. By this operation, the toner can be certainly broken and an aggregation of the toner can be eliminated.

Further, besides the aforementioned cases, although not required, it is effective if a vibration applying sequence is set into an initial sequence executed at a time of turning on a power in an image forming apparatus, or the sequence is executed every time the door of the image forming apparatus is opened or closed.

In a case of a high quality printing (when a toner is largely consumed), it is necessary to supply relatively much toner to the process cartridge 7. At this time, the aforementioned vibration applying sequence can be effectively executed in order to stabilize a supplying amount of the toner from the toner cartridge 9 to the process cartridge 7, regardless of aggregation of the toner. More specifically, by detecting a pixel-counted value or a residual toner amount using an information processing unit (not illustrated) provided in the apparatus body A, the vibration applying sequence can be executed to supply much toner to the process cartridge 7. Further, just after attaching a new process cartridge 7, the vibration applying sequence for supplying much toner can be executed regardless of the aggregation.

In addition, in this embodiment, the cam 21 as a swing member is provided in the process cartridge 7. However, in an alternative embodiment, the cam 21 is provided in the apparatus body A. Further, a crank mechanism can be used instead of the cam 21.

According to the aforementioned method, the toner aggregation can be eliminated in the presently used configuration without adding a new component or a complicated mechanism, and thus the occurrence of imaged defects can be avoided.

The aforementioned embodiments are described using a color image forming apparatus provided with four toner cartridges and four process cartridges. However, the present invention is not limited to these embodiments. Similar effects can be obtained also in a mono-color image forming apparatus. Further, in such monochrome embodiments, a process cartridge includes a process unit. The process unit includes at least one of a developing unit, a charging unit, and a cleaning unit.

While the present invention has been described with reference to exemplary embodiments, the invention is not limited to the disclosed exemplary embodiments. The scope of the following claims is to be accorded the broadest interpretation so as to encompass all modifications, equivalent structures, and functions.

This application claims priority from Japanese Patent Application No. 2007-309704 filed Nov. 30, 2007, which is hereby incorporated by reference herein in its entirety.

What is claimed is:

1. An image forming apparatus configured to form an image on a recording medium comprising:

a developing device comprising a first developer containing unit and a developing roller, the first developer containing unit having a receiving inlet for receiving developer from outside, the first developer containing unit containing the received developer, the developing roller configured to develop a latent image formed on an image bearing member using the developer contained in the first developer containing unit;

a developer cartridge comprising a second developer containing unit and a developer conveying member, the second developer containing unit containing developer and having a supplying outlet for supplying the contained developer to the receiving inlet, the developer conveying member provided at an inner side of the second developer containing unit and conveying the developer contained in the second developer containing unit to the supplying outlet, wherein the developer cartridge is detachably attached to an apparatus body of the image forming apparatus; and a vibration applying member configured to apply vibration to the second developer containing unit in a state where the developer conveying member is stopped after the developer cartridge is attached to the apparatus body and before the developer conveying member conveys the developer contained in the second developer containing unit to the supplying outlet.

2. The image forming apparatus according to claim 1, wherein the vibration applying member applies vibration to the second developer containing unit by receiving a driving force from the apparatus body.

3. The image forming apparatus according to claim 2, wherein the vibration applying member applies vibration to the second developer containing unit by moving the second developer containing unit from a second position to a first position after moving the second developer containing unit from the first position to the second position.

4. The image forming apparatus according to claim 3, wherein the vibration applying member applies vibration to the second developer containing unit a plurality of times between the first position and the second position.

5. The image forming apparatus according to claim 1, wherein the developer cartridge comprises a readable and writable storage member configured to store predetermined information, and wherein the apparatus body comprises a reading unit for reading the predetermined information from the storage member, and a writing unit for writing the predetermined information.

6. The image forming apparatus according to claim 5, wherein the predetermined information includes information whether the vibration applying member completes a predetermined vibration applying operation that applies vibration to the second developer containing unit.

7. The image forming apparatus according to claim 6, wherein after the reading unit reads information that the predetermined vibration applying operation is not completed from the storage member, the vibration applying member performs the predetermined vibration applying operation, and wherein after the predetermined vibration applying operation is completed, the writing unit writes the information concerning completion of the predetermined vibration applying operation into the storage member.

8. The image forming apparatus according to claim 7, wherein the developer cartridge includes a seal member that seals the supplying outlet and can be removed from the supplying outlet by receiving a force from the apparatus body, and wherein the apparatus body transmits the force to the seal member after the reading unit reads the information that the predetermined vibration applying operation is not completed from the storage member, and the vibration applying member performs the predetermined vibration applying operation after the seal member is removed from the supplying outlet.

9. The image forming apparatus according to claim 1, wherein the developer cartridge includes a first seal member that seals the supplying outlet and can be removed from the supplying outlet by receiving a force from the apparatus body, wherein after the apparatus body removes the first seal member, the vibration applying member applies vibration to the second developer containing unit.

10. The image forming apparatus according to claim 9, wherein the developing device has a second seal member that seals the receiving inlet and can be removed from the receiving inlet by receiving a force from the apparatus body, wherein after the apparatus body removes the second seal member, the first seal member is removed, and the vibration applying member applies vibration to the second developer containing unit.

11. The image forming apparatus according to claim 1, wherein the developing device bears the vibration applying member, wherein the vibration applying member applies vibration to the second developer containing unit through the receiving inlet and the supplying outlet by applying vibration to the developing device.

12. The image forming apparatus according to claim 11, wherein the supplying outlet contacts the receiving inlet via an elastic member.

13. The image forming apparatus according to claim 1, wherein the vibration applying member comprises a cam member.

14. The image forming apparatus according to claim 1, wherein the vibration applying member comprises a contacting/separating member configured to contact and separate the image bearing member and the developing roller.

15. The image forming apparatus according to claim 1, wherein the developing device is detachably attached to the apparatus body.

16. The image forming apparatus according to claim 1, wherein a process cartridge comprising the developing device and the image bearing member is detachably attached to the apparatus body.

* * * * *